US011629464B2

(12) United States Patent
Lee et al.

(10) Patent No.: US 11,629,464 B2
(45) Date of Patent: Apr. 18, 2023

(54) MODULAR PANELED STRUCTURE HAVING CONNECTIVE MEANS TO PREVENT GAP OPENING AND DISCONNECTION

(71) Applicants: Sung Woo Lee, Seoul (KR); Sangho Lee, Seoul (KR)

(72) Inventors: Sung Woo Lee, Seoul (KR); Sangho Lee, Seoul (KR)

( * ) Notice: Subject to any disclaimer, the term of this patent is extended or adjusted under 35 U.S.C. 154(b) by 190 days.

(21) Appl. No.: 17/197,482

(22) Filed: Mar. 10, 2021

(65) Prior Publication Data

US 2021/0332539 A1 Oct. 28, 2021

(30) Foreign Application Priority Data

Apr. 23, 2020 (KR) ..... 10-2020-0049062

(51) Int. Cl.
*E01D 19/12* (2006.01)
*E01D 101/24* (2006.01)
*E01D 101/30* (2006.01)

(52) U.S. Cl.
CPC ..... *E01D 19/125* (2013.01); *E01D 2101/24* (2013.01); *E01D 2101/30* (2013.01)

(58) Field of Classification Search
CPC ..... E01D 19/125; E01D 2101/24; E01D 2101/30
USPC ..... 14/73–74.5, 77.1, 78; 404/34–46
See application file for complete search history.

(56) References Cited

U.S. PATENT DOCUMENTS 5,647,184 A * 7/1997 Davis ..... E01C 5/20 52/592.1
5,941,027 A * 8/1999 Hallsten ..... E06B 3/485 52/246
6,467,118 B2 10/2002 Dumlao et al.
6,591,567 B2 7/2003 Hota et al.
7,131,161 B2 11/2006 Lee

FOREIGN PATENT DOCUMENTS

KR 10-2009-0059648 A 6/2009
KR 10-2010-0073448 A 7/2010
KR 10-1991765 B1 6/2019

* cited by examiner

*Primary Examiner* — Raymond W Addie
(74) *Attorney, Agent, or Firm* — Goldilocks Zone IP Law

(57) ABSTRACT

A modular paneled structure, comprising a main panel with a symmetric profile which has a closed-sectional portion in the middle and open-sectional portions at each end; and further comprising a cover panel which interconnects two side-by-side main panels, where the cover panel closes the open-sectional portions of the two side-by-side main panels forming a closed-sectional shape together with main panels; and further comprising a tensioning member which interconnects and pre-tensions the main panels that are placed side by side; and consequently, forms an assembled paneled structure with all these connective means, which is used to construct a paneled ground structures.

9 Claims, 41 Drawing Sheets

MODULAR PANELED STRUCTURE HAVING CONNECTIVE MEANS TO PREVENT GAP OPENING AND DISCONNECTION

CROSS-REFERENCE TO RELATED APPLICATION

This application claims priority to Korean Patent Application No. 10-2020-0049062 filed on Apr. 23, 2020, and all the benefits accruing therefrom under 35 U.S.C. § 119, the contents of which in its entirety are herein incorporated by reference.

BACKGROUND OF INVENTION

1. Field of Invention

The present invention relates to a modular paneled structure having connective means to prevent gap opening and disconnection, which consists of a main panel, a cover panel, and a tensioning member, assembly procedures to connect such modular paneled structures with each other to create an assembled paneled structure, and paneled ground structures constructed using such assembled paneled structures.

2. Description of the Related Art

In common practice, a bridge deck is constructed with reinforced concrete. However, with time, concrete deterioration and corrosion of reinforcing bars accelerate, thereby causing increased maintenance costs, shortening the service life of the bridge deck, and jeopardizing structural safety. To resolve these problems of a conventional concrete deck, and as an alternative to concrete, fiber reinforced composite decks having characteristics of high durability, light weight and high strength are proposed.

A variety of fiber reinforced composite decks of modular types are disclosed in previous patents, typically including U.S. Pat. Nos. 6,467,118 and 6,591,567. In most cases, the modular decks in U.S. Pat. Nos. 6,467,118 and 6,591,567 of the prior arts, despite utilizing many advantages of composites, are made to connect with each other in a horizontal direction with male and female ends, utilizing tongue and groove methods with adhesives. Unfortunately, this horizontal adhesive connection method in the prior arts reveals many drawbacks. Typically, problems include shear stud connection of deck to girder, which reduces construction quality and workability by working through pre-drilled holes in the deck, and making it impossible to disassemble bonded decks for repair or reuse. Other problems include structural performance issues due to questions regarding durability of the adhesive bonding, and further increasing costs of installation.

U.S. Pat. No. 7,131,161 B2 of the prior arts, registered by this inventor, discloses modular composite decks with vertical snap-fit connection, and resolves most of the aforementioned drawbacks. However, this prior art also has revealed some other drawbacks to be resolved.

FIG. 1, which is FIG. 2A disclosed in the prior art of U.S. Pat. No. 7,131,161 B2, shows a perspective view of interconnecting composite deck panels of axisymmetric profile with vertical snap-fit connection.

As shown in FIG. 1, the downward protruded interlocking piece 15*a* of deck 1*a* and the concave upward U-shape interlocking piece 16*a* of deck 1*b* are coupled and interlocked with each other at the upper part of the decks 1*a* and 1*b* to build a vertical interlocking snap-fit connection with each other. Also, upward protruded interlocking piece 16*b* of deck 1*b* and the concave downward inverted U-shape interlocking piece 15*b* of deck 1*a* are coupled and interlocked each other at lower part of the decks 1*a* and 1*b*, as an inverted position to the above-mentioned case, to build vertical interlocking snap-fit connection with each other.

However, in this profile of the prior art, if upward loading, upward vibration, or eccentric loading is applied to the deck, negative bending moment is induced in the deck, which will cause convex upward deflection. Owing to this negative bending moment, the gap in the snap-fit connected portions in the upper part of the snap-fit connected decks 1*a* and 1*b* of FIG. 1 opens up as shown in FIG. 2, a photo taken during the laboratory experiments for the decks, slightly deviating from decks 1*a* and 1*b* of the prior art, shown in FIG. 1. Consequently, this phenomena will further cause the decks to fall out and lead to disconnections of connected decks in a vertical direction from the upper part of the decks, thereby jeopardizing the structural safety of the connected decks. Further, this gap opening and disconnection of the connection will also induce raised bumps and transverse cracks in the pavement perpendicular to driving direction, reducing riding comfort when used in a bridge deck.

Similarly in the reverse direction, if downward loading, downward vibration, or eccentric loading is applied to the deck of the prior art, positive bending moment is induced in the deck, which will cause convex downward deflection. Owing to this positive bending moment, the gap in the snap-fit connected portions in the lower part of the deck 1*a* and 1*b* of the prior art shown in FIG. 1 opens up, rotating FIG. 2 in 180°. Consequently, this phenomena will further cause the decks to fall out and lead to disconnection of the connected decks in a vertical direction from the lower part of the decks, thereby jeopardizing structural safety of the connected decks.

In addition, as shown in FIG. 1, the neighboring decks 1*a* and 1*b* of the prior art, snap-fit connected with each other with protrusions 15*a* and 16*a*, and 15*b* and 16*b*, respectively, are only in a vertically interlocked state, and further such snap-fit connections are repeated in a longitudinal direction as shown in FIG. 1. Consequently, the connected decks will slide out from each other in a transverse direction to cause disconnection of the decks in a transverse direction, since the prior art does not have any means of preventing this phenomena. For this reason, when excessive lateral loads in a transverse direction is applied to the deck during the service period, connected decks of the prior art can slide out from each other in a transverse direction, jeopardizing structural safety of the connected decks. Further, this sliding movement will also induce transverse cracks in the pavement perpendicular to driving direction, reducing the riding comfort when it is used in a bridge deck.

For the deck of the prior art, shown in FIG. 1, if an upward force exceeding a certain level is exerted to the decks, which are connected vertically through interlocking snap-fits, but without any compulsory means of preventing the pull-out, the decks of the prior art can be pulled out vertically and induce raised bumps at the connection, or in more severe conditions, the decks will fall out during the service period, thereby reducing riding comfort and further jeopardizing driving safety.

During the practice of the prior art, disclosed in U.S. Pat. No. 7,131,161 B2, to resolve the aforementioned drawbacks at the connected portions in transverse and vertical directions, adhesive is occasionally applied in the course of connecting as shown in FIG. 3. However, if the applied forces are beyond the strength of the adhesive bonding, the adhesive bonding method will not be enough to resolve the problems. Further, the strength of adhesive will weaken due to repetitive loading during the bridge service. With the weakened adhesive at the connection, eventually a gap in the connection will open up, and further cause disconnection in transverse or vertical directions, jeopardizing structural safety of the deck of the prior art.

In some cases, replacement or repair of decks is necessary due to partial damage or other reasons. In other cases, disassembly of the entire deck panels is necessary for reuse or redecking. In the process of assembling the decks of the prior art as shown in FIG. 1, the succeeding deck is successively snap-fit connected in an overlapping way to the previously assembled deck in the longitudinal direction. If one of the panels located in the middle area of the assembled decks needs to be removed, disassembly of the decks is necessary all the way until that certain deck is reached. This process is too cumbersome and overly costly for such partial removal. Such limitation in the prior art as shown in FIG. 1 makes it practically difficult to remove and replace decks in the middle of the assembled decks.

SUMMARY OF THE INVENTION

The present invention is directed to overcome the above-mentioned disadvantages or limitations occurring in the conventional modular panel or in paneled structures constructed using these conventional modular panels.

It is an objective of the present invention to provide a modular paneled structure having connective means to prevent gap opening and disconnection, consisting of a main panel, a cover panel, and a tensioning member; and to provide assembly procedures to connect such modular paneled structures with each other to create an assembled paneled structure; and also to provide paneled ground structures constructed using such assembled paneled structures. The modules in the modular paneled structure in accordance with the present invention are assembled and firmly connected with each other with connective means using a stud-bolt, a web-bolt, a tensioning member, an interlocking snap-fit, and a lock-bolt, consequently forming structurally stable closed-sectional shapes throughout the connected panels. The connective means which connect the modules in the modular paneled structure provide pure mechanical connection without adhesive bonding, not only preventing gap opening and disconnection at connected sites but also improving structural safety, serviceability, maintainability, reusability, construction workability, and quality of the assembled paneled structure.

In order to accomplish this objective of the present invention, a modular paneled structure is presented, comprising a main panel with a symmetric profile which has a closed-sectional portion in the middle and open-sectional portions at each end, wherein the closed-sectional portion comprises an upper plate, a lower plate, and inner webs (including the outermost inner web) connecting the upper and lower plates to form a plurality of divisional cells of polygonal tubular cross-sectional shapes between the upper and lower plates, wherein the open-sectional portion comprises an extended lower plate, an upward outer web at the end of the extended lower plate, and the outermost inner web which is shared in common with the closed-sectional portion; and further comprising a cover panel with a symmetric profile of an open-sectional portion which interconnects two side-by-side main panels, where the cover panel closes the open-sectional portions of the two side-by-side main panels forming a closed-sectional shape together with main panels, wherein the cover panel comprises an upper plate, two downward outer projected portions which each project from the upper plate at each end, and two downward inner projected portions in the mid-section of the cover panel in-between the outer projected portions which project from the mid-section of the upper plate; and further comprising a tensioning member which interconnects and pre-tensions the main panels that are placed side by side, wherein the tensioning member is anchored at the outermost inner web of each main panel placed side-by-side and passes through a slit and an anchorage hole which are formed in the outermost inner web and upward outer web of the main panel, and thereafter exerts pre-tensioning force in-between the two main panels, wherein the tensioning member can be re-tensioned if necessary upon disassembling the cover panel; and consequently, forms an assembled paneled structure with all these connective means.

BRIEF DESCRIPTION OF THE DRAWINGS

The above and other objects, features and advantages of the present invention, will be more apparent from the following description taken in conjunction with the accompanying drawings, in which.

DETAILED DESCRIPTION

Figure 1:
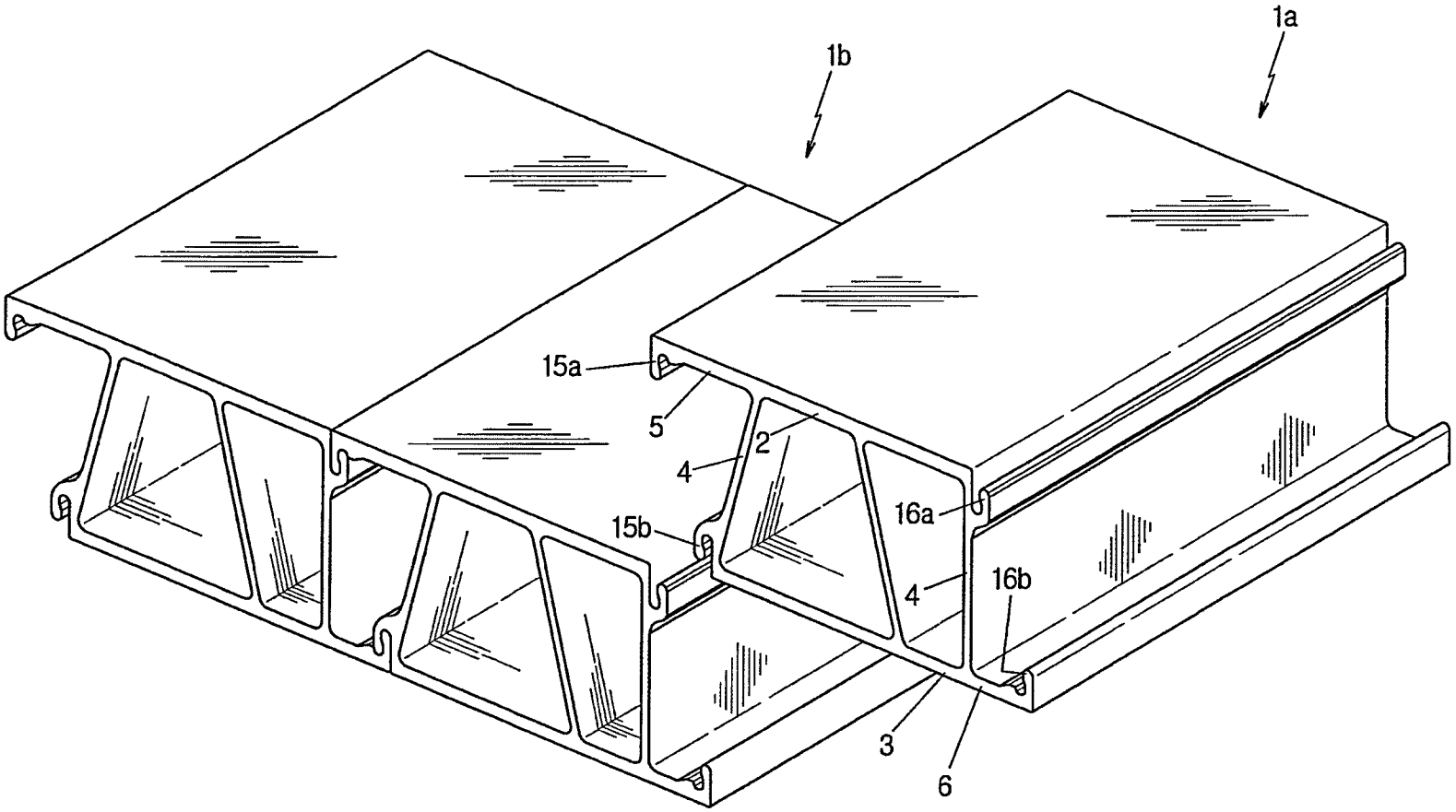
FIG. 1 (Prior Art)
FIG. 1 is a perspective view showing assembly state of asymmetric deck of the prior art, having interlocking snap-fit connection.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 4:
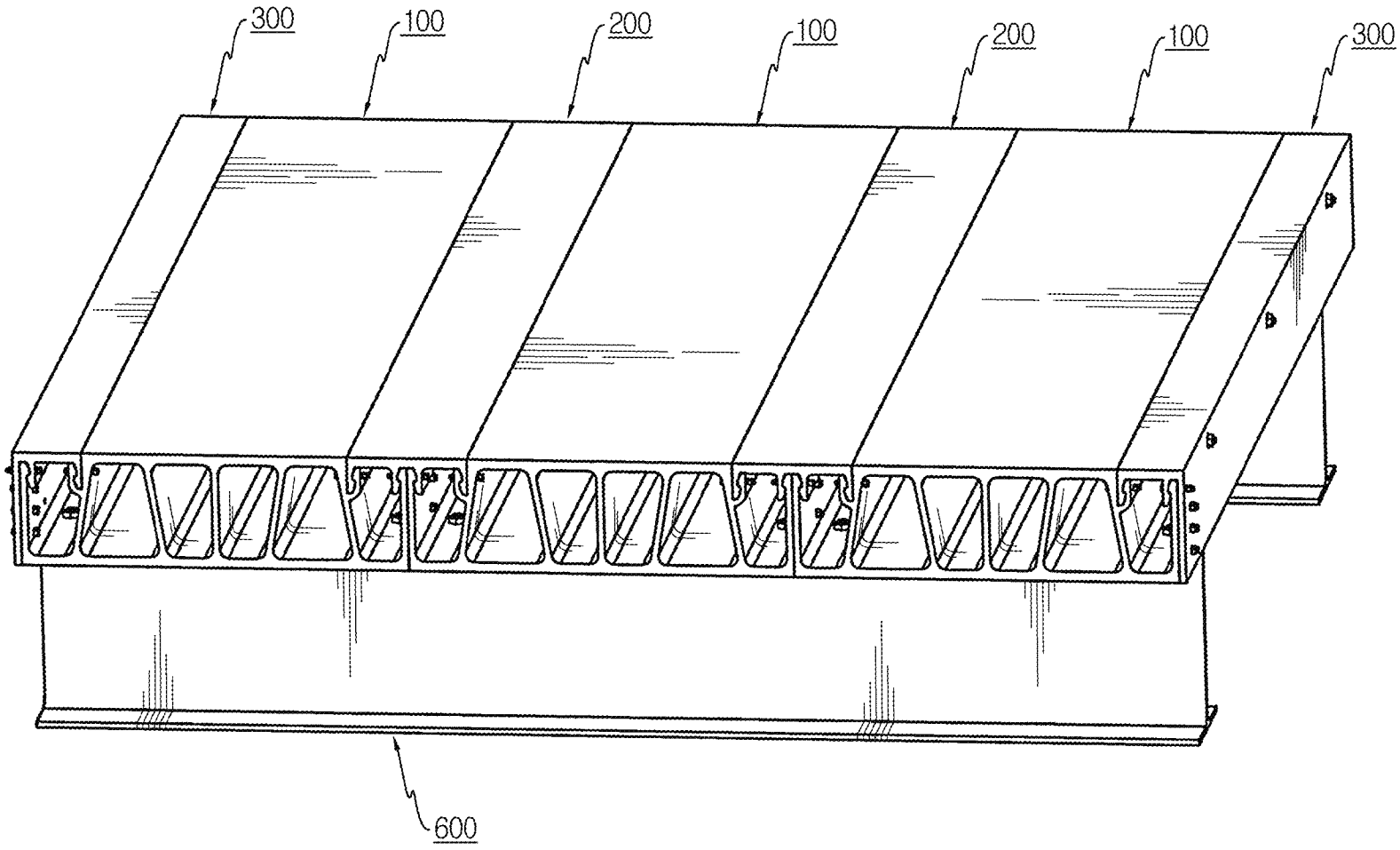
FIG. 4 is a perspective view showing an assembled and connected main panel, a cover panel and an end panel of the present invention, placed upon an supporting member.

FIG. 4 is a perspective view showing an assembled and connected main panel 100, a cover panel 200 and an end panel 300 of the present invention, placed upon a supporting member 600.

As shown in FIG. 4, the cover panels 200 are covered over connecting portions of two neighboring main panels 100 by closing the open-sectional portions. The end panels 300 are connected at beginning and ending portions of the connected panels.

A supporting member 600 is a structure supporting the panels, placed underneath of it. The supporting member 600 could be steel girder, reinforced concrete girder, pre-stressed concrete girder, precast concrete girder, H-shaped beam, I-shape beam or any other shape of beam. When the paneled structure of the present invention is used as a deck of bridge or a floor of building, supporting structure can be a girder or a beam, and when it is used as a wall structure, it can be a column.

Hereinafter, the main panel, the cover panel, the end panel and their interconnection mechanism will be disclosed in more detail.

Main Panel 100

Figure 5:
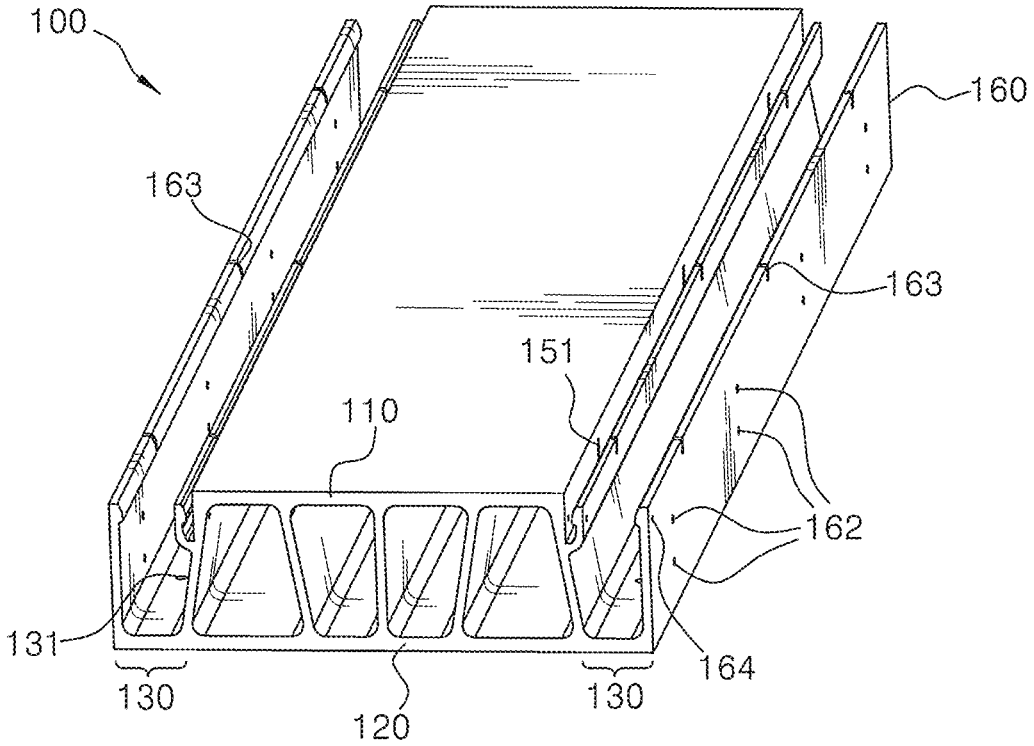
FIG. 5 is a perspective view showing the main panel of the present invention.
Figure 6:
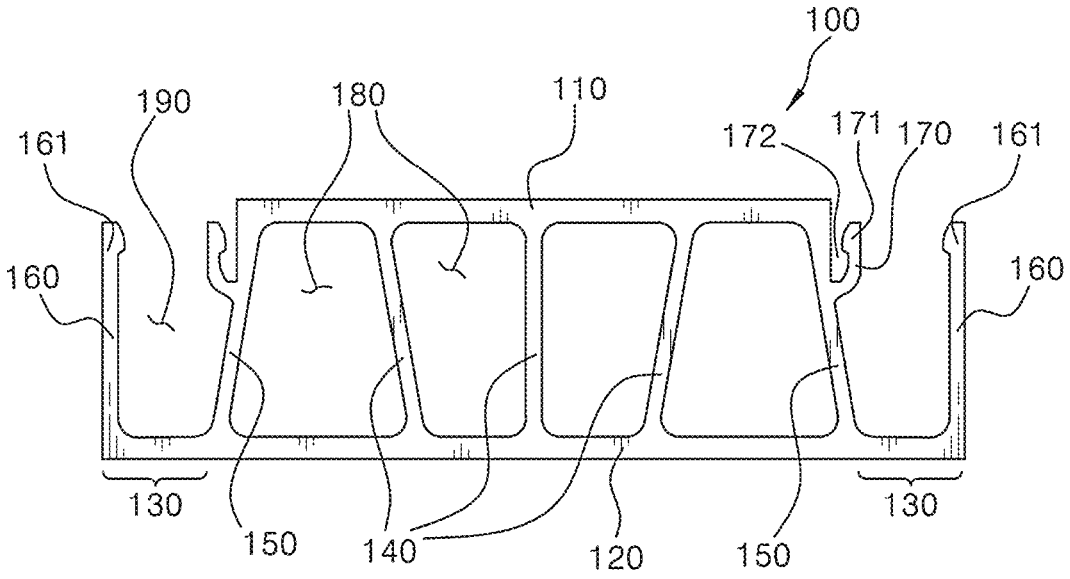
FIG. 6 is a cross-sectional view of the main panel of the present invention.
Figure 7:
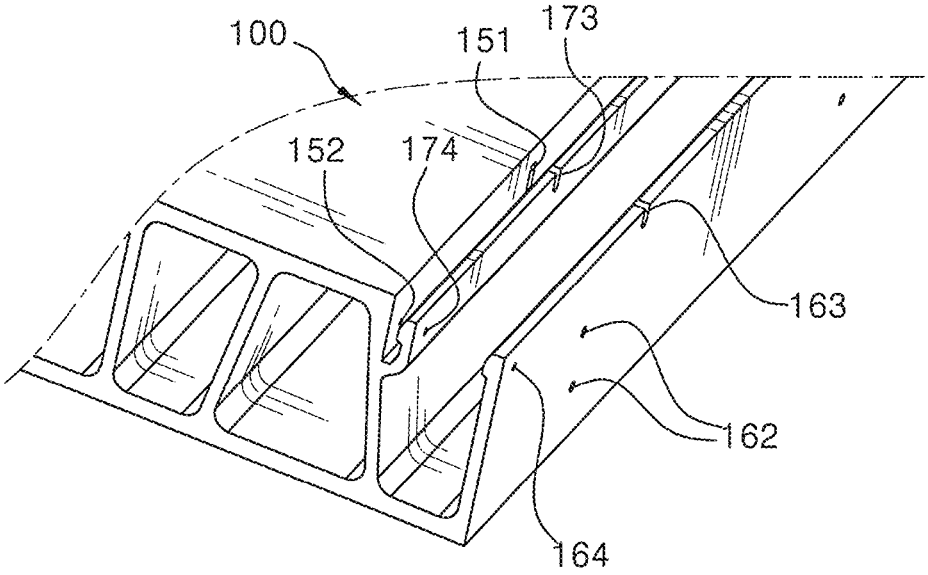
FIG. 7 is a partial perspective view of the main panel of the present invention.

FIGS. 5 to 7 are different views of the main panel 100 of the present invention. As shown in FIGS. 5 to 7, the main panel 100 with a symmetric profile which has a closed-sectional portion 180 in the middle and open-sectional portions 190 at each end, wherein the closed-sectional portion comprises an upper plate 110, a lower plate 120, and inner webs 150 (including the outermost inner web 150), connecting the upper and lower plates to form a plurality of divisional cells 180 of polygonal tubular cross-sectional shapes between the upper and lower plates, wherein the open-sectional portion comprises an extended lower plate 130, an upward outer web 160 at the end of the extended lower plate, and the outermost inner web 150 which is shared in common with the closed-sectional portion.

Figure 11A:
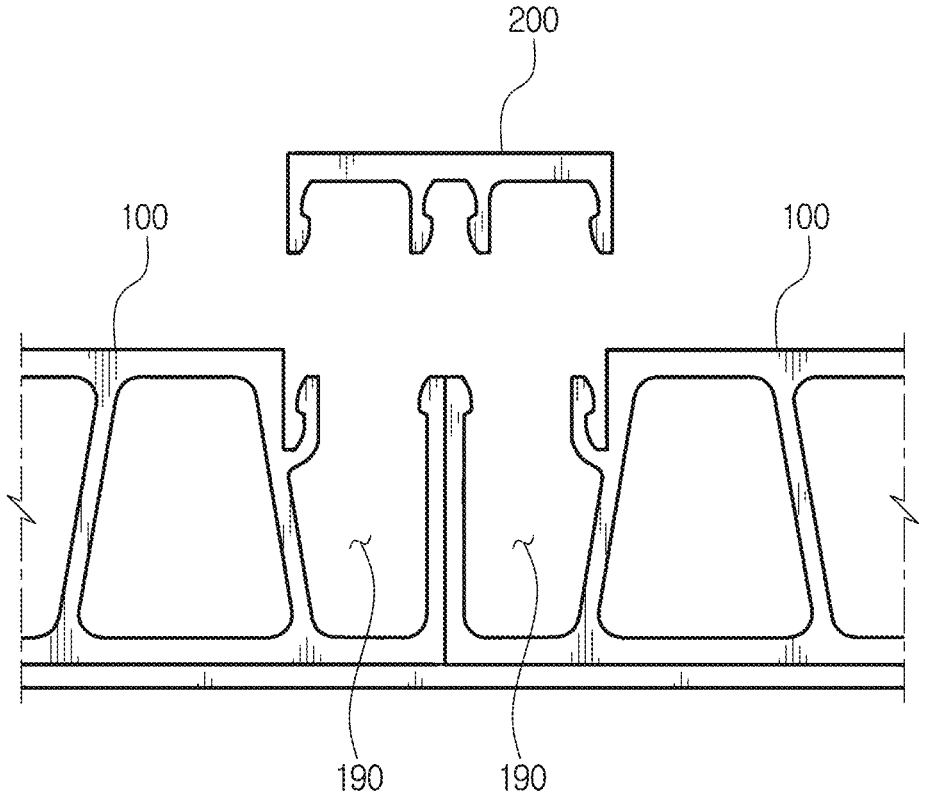
FIGS. 11A, 11B and 11C are cross-sectional view showing progressive steps of concavo-convex interlocking snap-fit connection of the present invention, respectively, between neighboring main panels and cover panel.
Figure 11B:
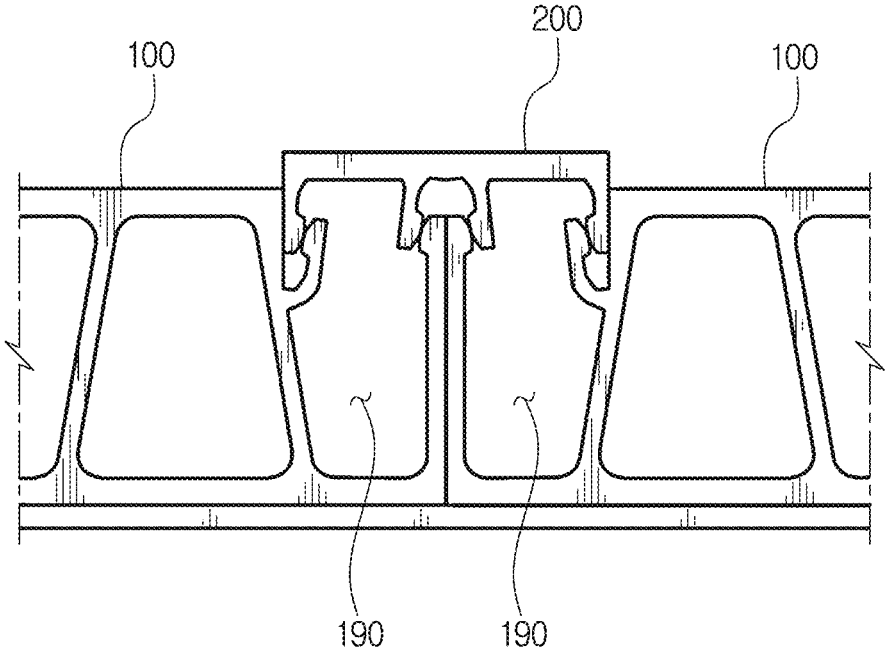
Figure 12:
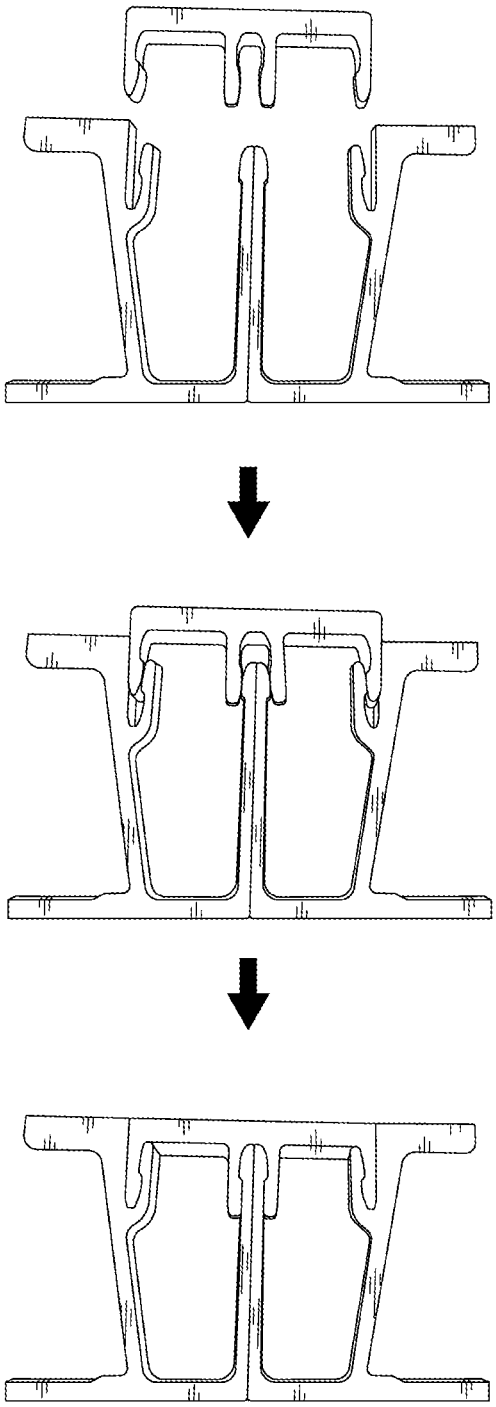
FIG. 12 is a series of photos of 3D printed prototype of the present invention, corresponding to FIGS. 11A, 11B and 11C.

Further, in the main panel 100 of the present invention, an upward projected portion 170 together with an upward interlocking protrusion 171 at the end of such upward projected portion, formed at the upper outer side of the outermost inner web, subsequently forming a concave upward U-shape 172 in-between the outermost inner web 150 and upward projected portion 170, an upward interlocking protrusion 161 at the upper end portion of the outer web 160 of the main panel, to provide concavo-convex interlocking snap-fit connection with cover panel 200, as shown in FIGS. 11A and 11B and FIG. 12.

Figure 37:
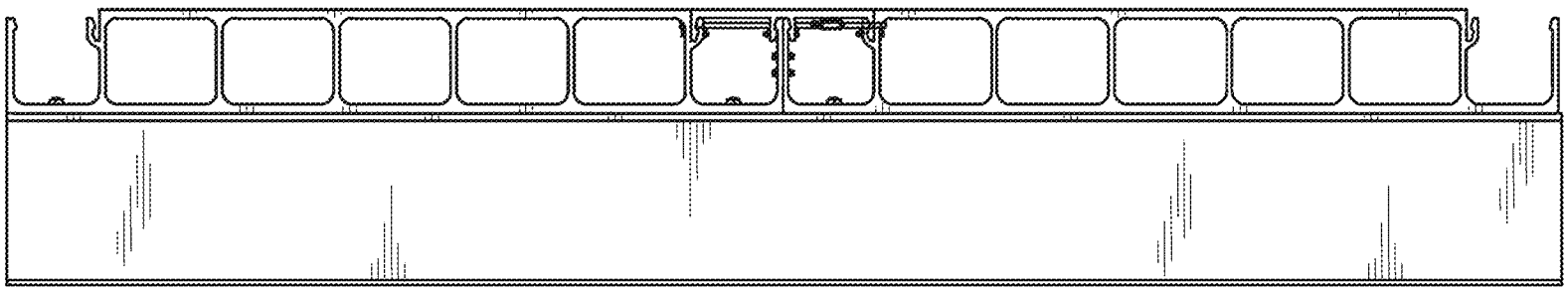
FIG. 37 is a front view of connected panel, showing the main panels and their connected portions with the cover panel can be comprised of other type of hollow-sectional shape, according to other embodiments of the present invention.
Figure 39:
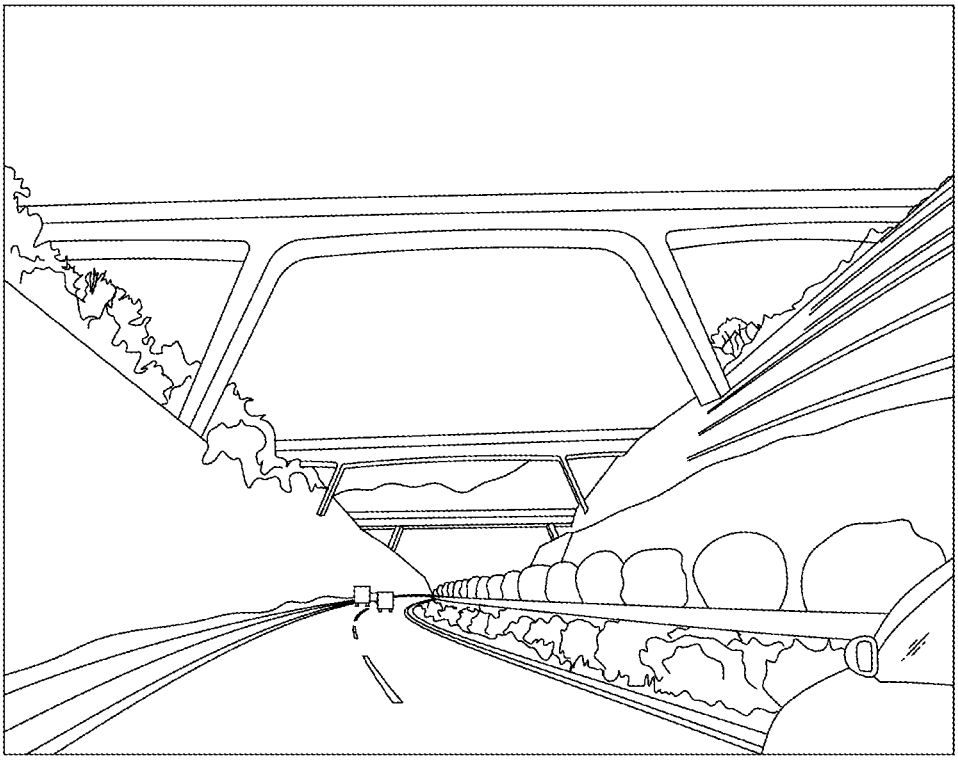
FIG. 39 is a photo showing a bridge of structurally stable shape of 'π'-type, which may be other type of hollow-sectional shape comprising the main panel, when formed together with enclosing perimeter, according to other embodiments of the present invention.

As shown in FIGS. 5 to 7, closed-sectional portion of main panel consists of 4 hollow cells of trapezoidal shape in this illustration, however more number and different shape of cells can be formed as shown in FIG. 37, thereby number of cells can be varied and the shape of cells can be varied as well in any form of polygonal shape, including but not limited to rectangular shape as in FIG. 37 or shape of enclosed 'π'-type as in FIG. 39, according to other embodiments of the present invention.

The main panel 100 of the symmetric shape of the present invention, comprising 4 hollow cells in the closed-sectional portion, is connected with stud-bolts 701 onto the supporting member 600 at both side of extended open portions, whereby to resist shearing forces in-between. Apparently, this type of panel possesses doubly increased shear resisting capacity compared to the asymmetric panel of the prior art in FIG. 2, comprising 2 hollow cells and providing only one connecting spot at an extended portion. Accordingly, compared to the prior art, the panel of double width of the present invention provides advantage of reducing frequency of connections, so that it saves production costs and increases the speed of installation.

Figure 33:
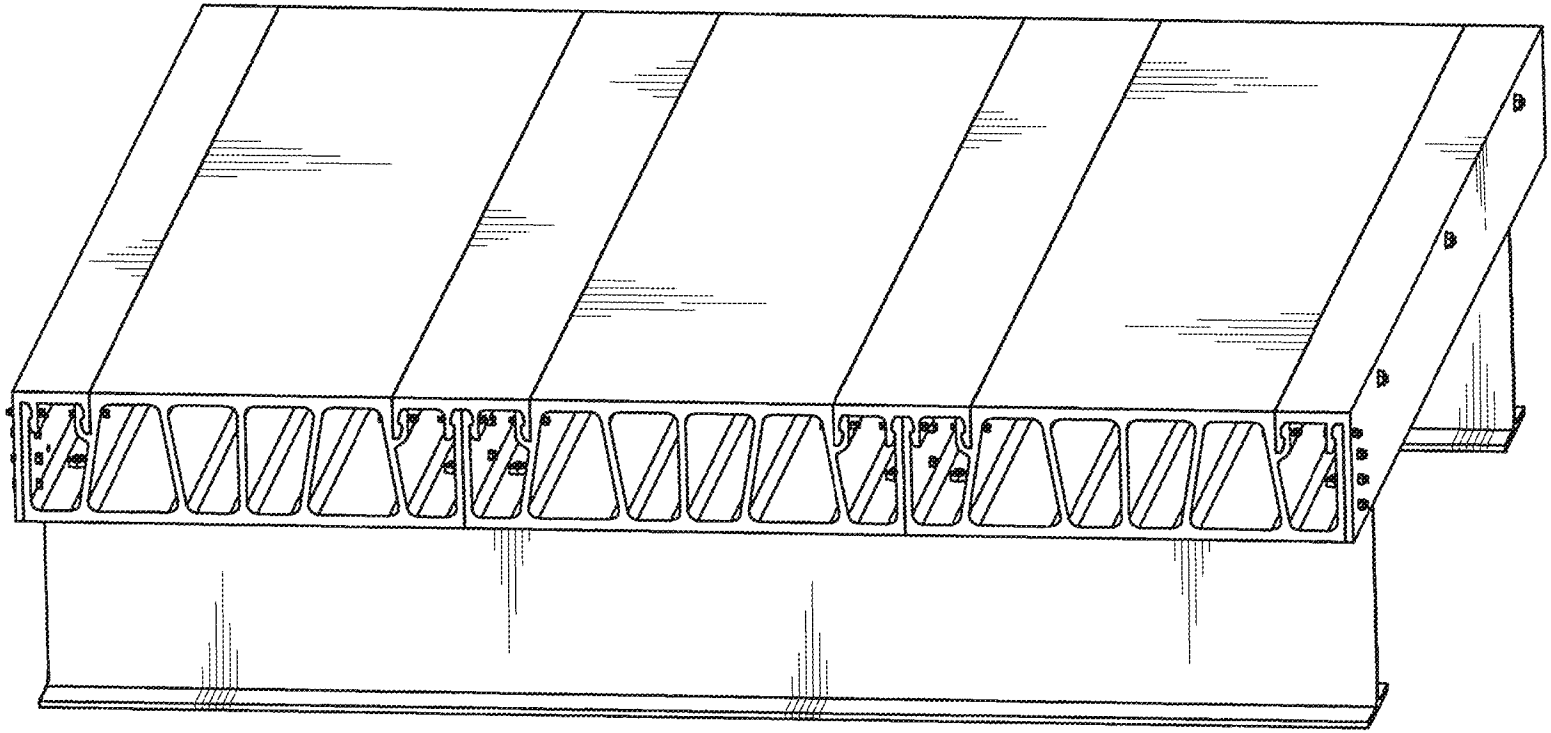
FIG. 33 is a perspective view of connected panels of the present invention showing the main panels, the cover panels and the end panels are interconnected with each other over the supporting member, onto which main panels are connected.

As shown in FIGS. 5 to 7, the outermost inner webs 150 of the main panel 100 are preferably inclined to form an upward wider open-sectional shape as in this illustration, thereby it provides more room for the worker's hand, facilitating bolting connections to the supporting member 600 as well as between the neighboring main panels 100. As shown in FIGS. 4 and 33, when the neighboring panels are interconnected with cover panel 200, the open-sectional portions are transformed to the closed-sectional shape. The sectional-shape of half of this connected panels resembles a shape of enclosed 'π'-type bridge in FIG. 39, which is structurally stable and long experienced shape. Consequently, the continuously connected paneled structure, formed in a closed-sectional shape throughout, of the present invention as shown in FIGS. 4 and 33, is considered as a uniformly produced paneled structure having a pattern of repeating a unit of enclosed 'π'-shape, possessing well proven structural performance. An enclosed 'π'-shape of the connected paneled structure is exemplified above, however, cross-sectional shape of connected paneled structure can be any combination of polygonal shapes, according to other embodiments of the present invention.

Figure 17:
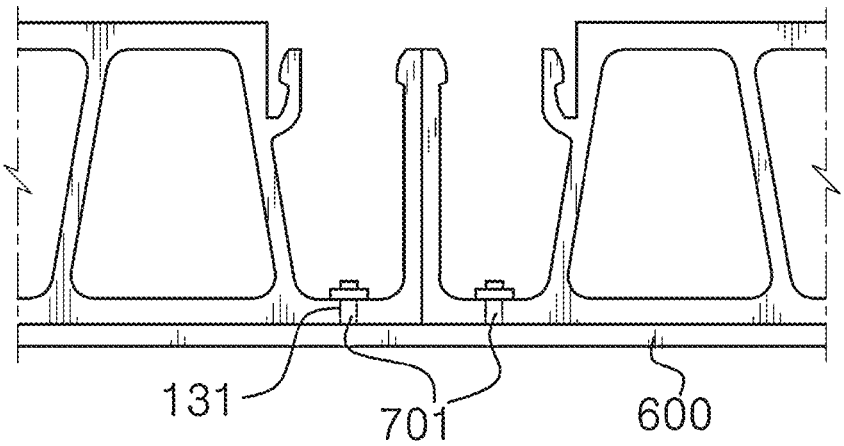
FIG. 17 is an enlarged partial cross-sectional view showing neighboring main panels, placed upon supporting member, are connected onto it with stud-bolts of the present invention.

As shown in FIG. 5, a stud-bolt hole 131 is formed at the extended lower plate, to connect the main panel 100 onto the supporting member 600 with stud-bolt 701 as shown in FIG. 17.

Figure 18:
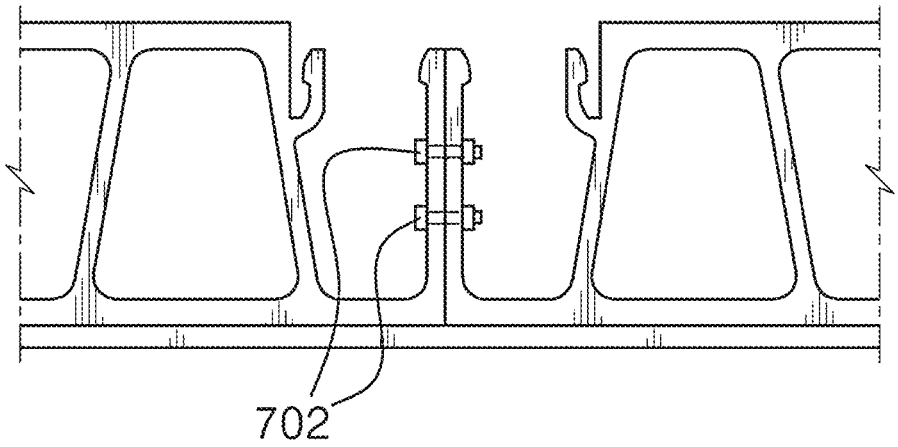
FIG. 18 is an enlarged partial cross-sectional view showing neighboring main panels are connected each other with web-bolts of the present invention

In addition, web-bolt holes 162 are formed in the vertical and horizontal direction within the upward outer web 160, to connect neighboring main panels 100 with each other with web-bolts 702 as shown in FIG. 18.

As shown in FIGS. 5 and 7, an anchorage hole 151, having distances in transverse direction, is formed at upper portions of the outermost inner web 150 of the main panel, to anchor the first and second anchorage heads of the tensioning member 400, and the third anchorage head of the end-tensioning member 500, as shown in FIGS. 19 to 21 and 31.

Figure 19:
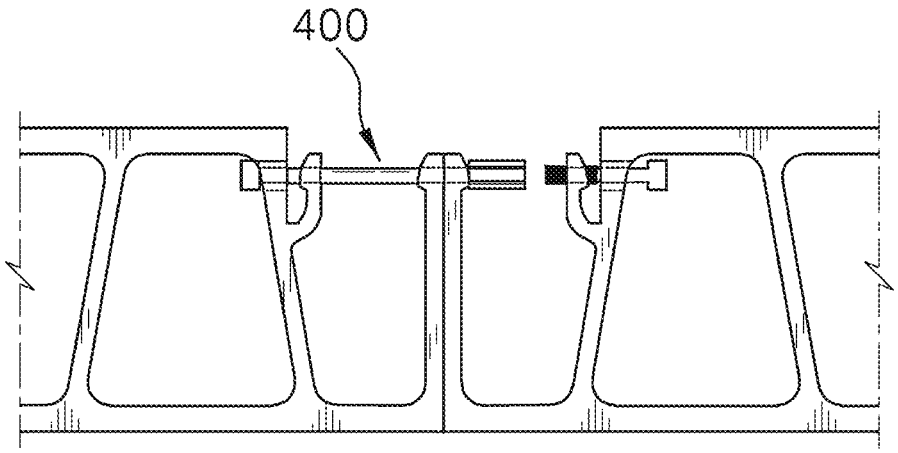
FIGS. 19 and 20 are enlarged partial cross-sectional views showing the first phase and the second phase of progressive steps respectively, pre-tensioning at upper side of the neighboring main panels with tensioning member of the present invention.
Figure 20:
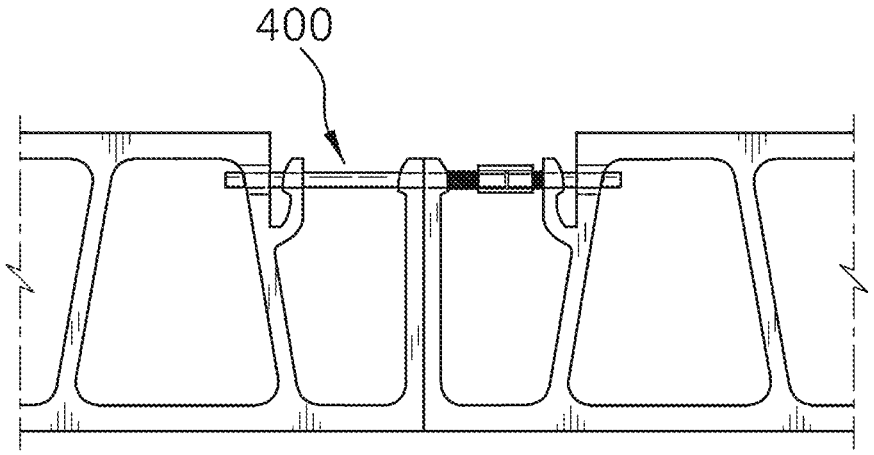
Figure 21:
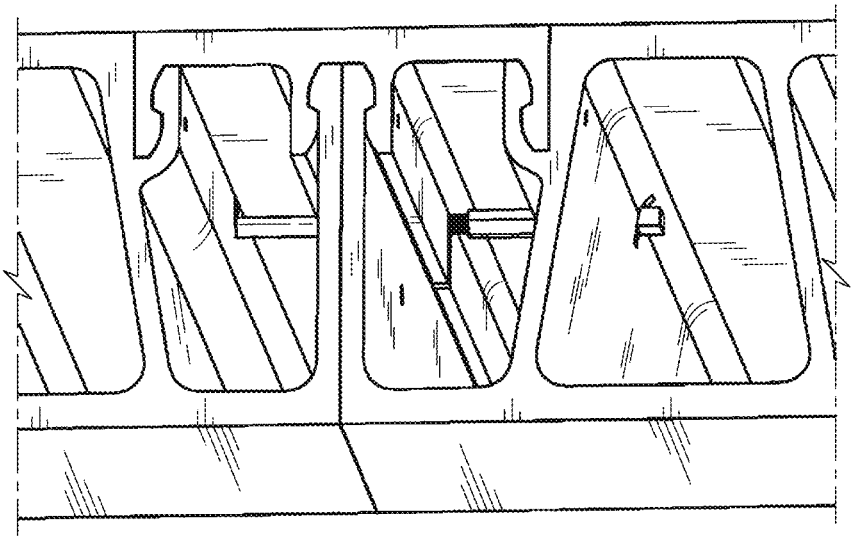
FIG. 21 is a partial prospective view showing neighboring main panels are pre-tensioned with tensioning a member of the present invention.
Figure 22A:
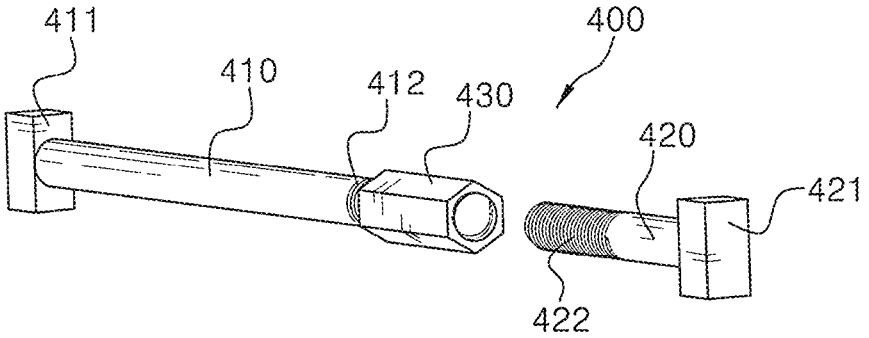
FIGS. 22A and 22B are perspective views of the tensioning member of the present invention, showing the heads of bars are positioned to pass through the anchorage hole, and those of them are rotated in 90° and positioned to be anchored at outside of anchorage hole, respectively.
Figure 22B:
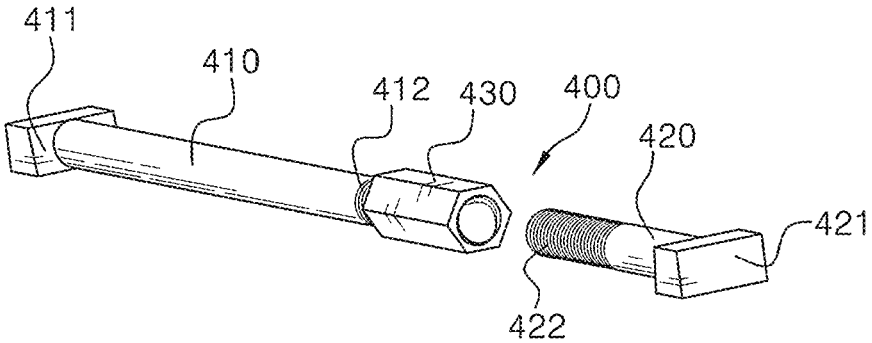
Figure 23A:
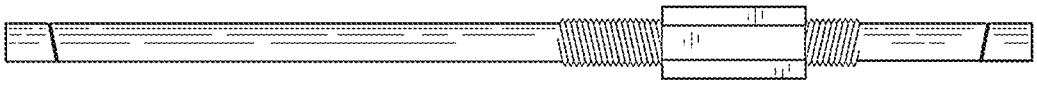
FIGS. 23A and 23B are a front view and an enlarged cross-sectional view of tensioned state of the tensioning member of the present invention, respectively, showing tensioning state is manifested by pulling the tensioning bars with each other through the coupler.
Figure 23B:
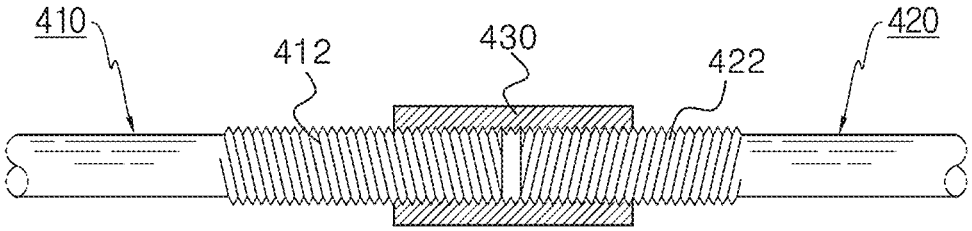

Further, next to the anchorage hole 151, slit 173 at the interlocking protrusion 171, and another slit 163, next to it, in the upper portion of upward outer web 160, are formed respectively, in the coincident line with each other, to provide space for tensioning member when it gets through as shown in FIGS. 19 to 21.

Figure 29:
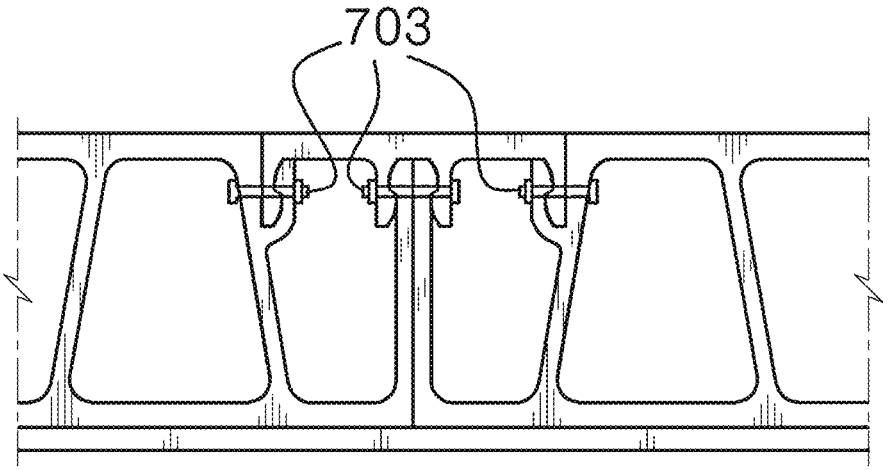
FIG. 29 is an enlarged partial cross-sectional view showing snap-fit connected portions of the present invention are tightened with lock-bolts.
Figure 30:
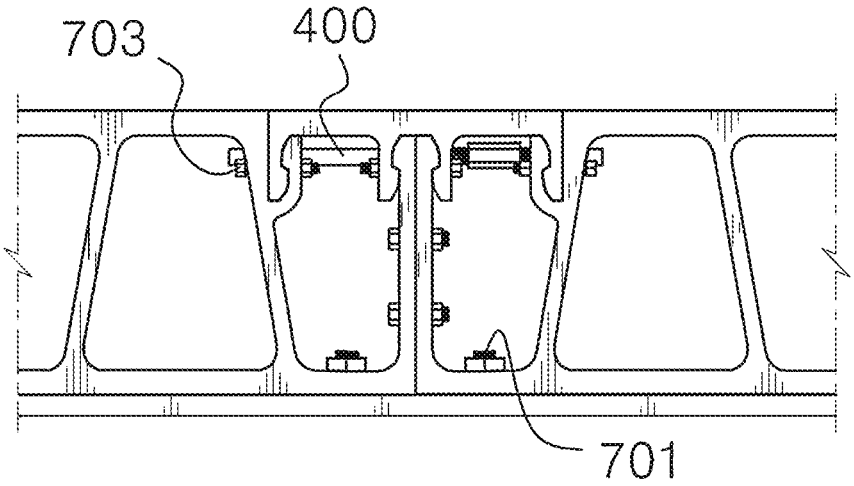
FIG. 30 is an enlarged partial front view showing all the connected states in the main panel and cover panel of the present invention, including the connections of panel to supporting member and panel to panel.

In addition to above, lock-bolt hole 152 at upper portion of the outermost inner web 150, another lock-bolt hole 174, with next to it, at the interlocking protrusion 171, and the other lock-bolt hole 164 at upper portion of the upward outer web 160 are formed, respectively, at the main panel 100, in the coincident line with each other, to fasten lock-bolts 703 in the snap-fit connected portions as shown in FIGS. 29 and 30.

Cover Panel 200

Figure 8:
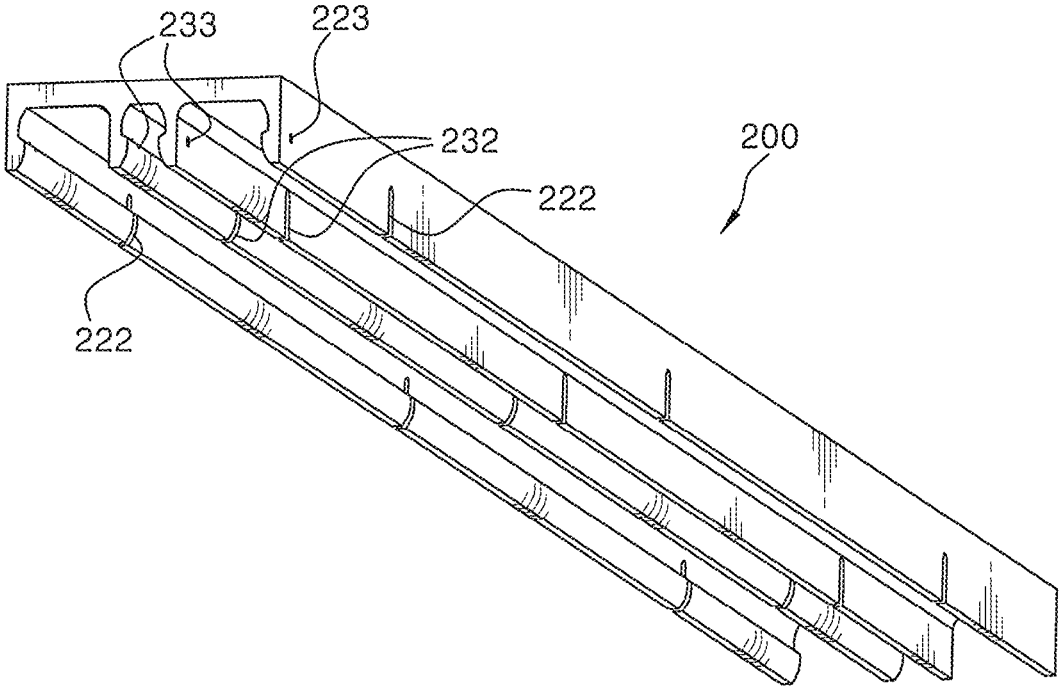
FIG. 8 is a perspective view showing the cover panel of the present invention.
Figure 9:
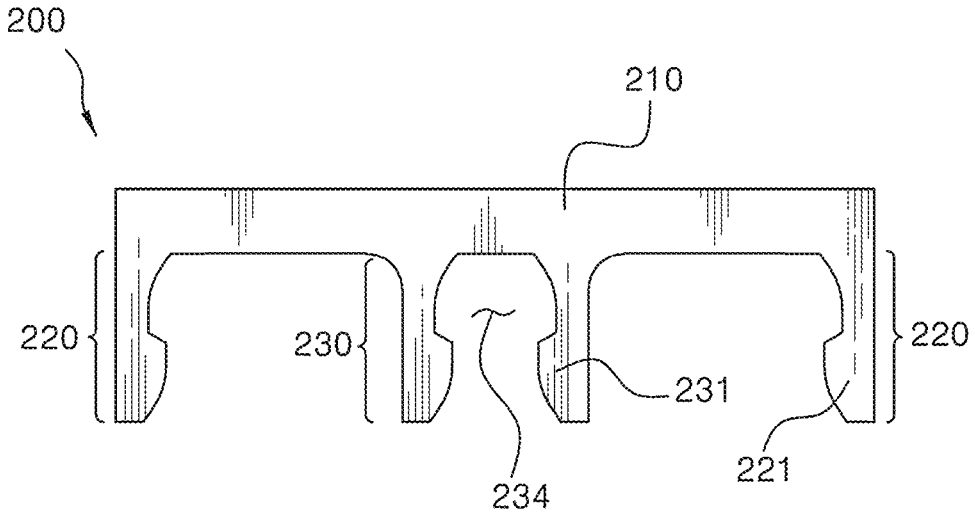
FIG. 9 is a cross-sectional view of the cover panel of the present invention.
Figure 10:
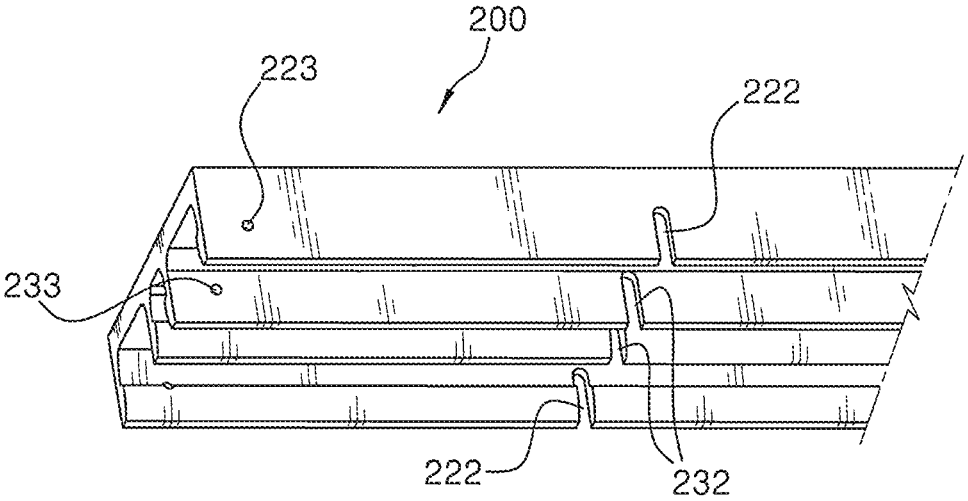
FIG. 10 is a partial perspective view of the cover panel of the present invention.

FIGS. 8 to 10 are different views of a cover panel 200 of the present invention. As shown in FIGS. 8 to 10, the cover panel 200 with a symmetric profile of an open-sectional portion which interconnects two side-by-side main panels 100, where the cover panel closes the open-sectional portions of the two side-by-side main panels, wherein the cover panel 200 comprises an upper plate 210, two downward outer projected portions 220 which each project from the upper plate at each end, and two downward inner projected portions 230 in the mid-section of the cover panel in-between the outer projected portions 220 which project from the mid-section of the upper plate.

In addition, in the cover panel 200 of the present invention, a downward interlocking protrusion 221 at the lower end and a slit 222 formed in the downward outer projected portion 220, where each downward inner projected portion 230 of the cover panel has a downward interlocking protrusion 231 at the lower end, forming a concave inverted U-shape 172 in-between the two inner projected portions 230 of the cover panel, and a slit 232 formed in the downward inner projected portion 230, to provide concavo-convex interlocking snap-fit connections with the cover panel 200 and neighboring main panels 100 as shown in FIGS. 11A and 11B and FIG. 12.

Further, a slits 222 are formed in the outer projected portions 220, and other slits 232 are formed in the inner projected portions 230 of the cover panel 200, where these slits are located in the coincident line with corresponding the anchorage hole 152, the slit 173, and another slit 163 of the main panel 100, to provide common space for tensioning member 400 to get through when the cover panel is connected with the main panel, as shown in FIGS. 19 to 21.

In addition to above, a lock-bolt hole 223 in the outer projected portion 220, and other lock-bolt hole 233 in the inner projected portion 230 are formed, respectively, at the cover panel 200, in the coincident line with corresponding lock-bolt hole 152, another lock-bolt hole 174 next to it, and the other lock-bolt hole 164 of the main panel 100, to fasten the lock-bolts 703 in the snap-fit connected portions as shown in FIGS. 29 and 30.

End Panel 300

Figure 13:
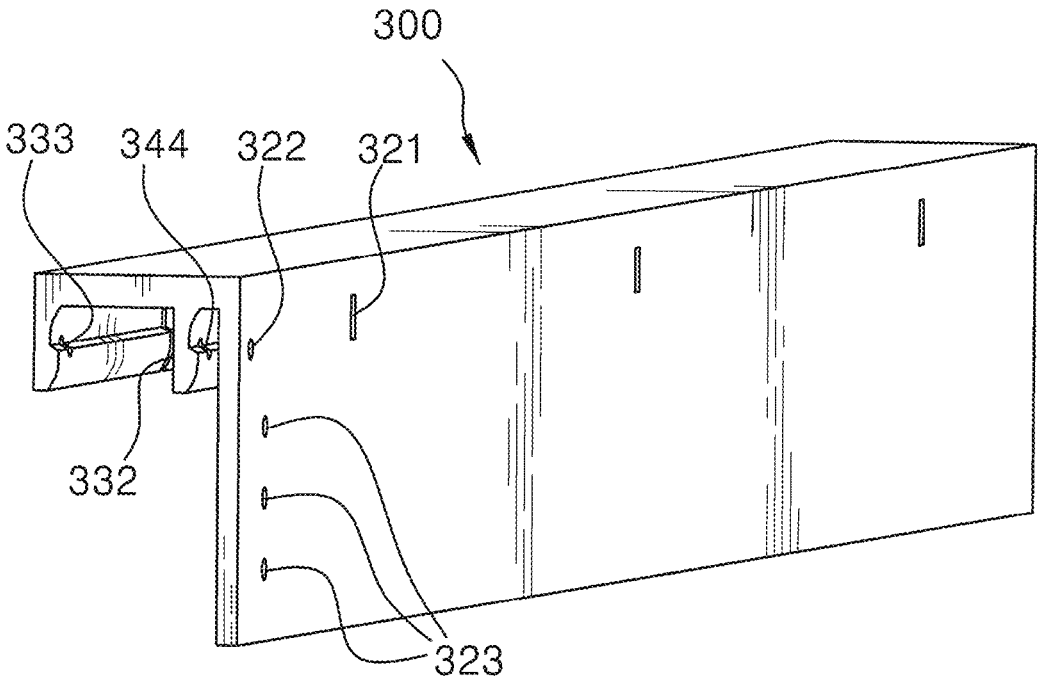
FIG. 13 is a perspective view showing the end panel of the present invention.
Figure 14:
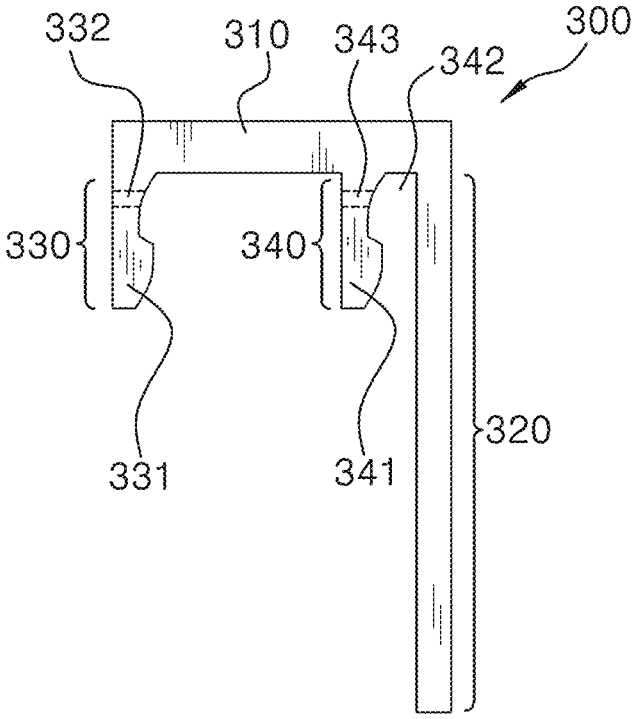
FIG. 14 is a cross-sectional view of the end panel of the present invention.

FIGS. 13 and 14 are different views of an end panel 200 of the present invention, forming the closed-sectional shape at beginning and ending portion of the connected panels. As shown in FIGS. 13 and 14, the end panel 300 is formed in a non-symmetric profile with an open-sectional shape.

The end panel comprises an upper plate 310, a downward outer web 320 which is perpendicularly connected with the upper plate at the end side, a downward outer projected portion 330 projected from the other end of upper plate 210, a downward inner projected portion 340 projected from the upper plate in-between the outer web 320 and the outer projected portion 330, a slit 332 formed in the downward projected portion, a slit 343 formed in the downward inner projected portion, and an anchorage hole 321 formed at the outer web 320 of the end panel.

Figure 31:
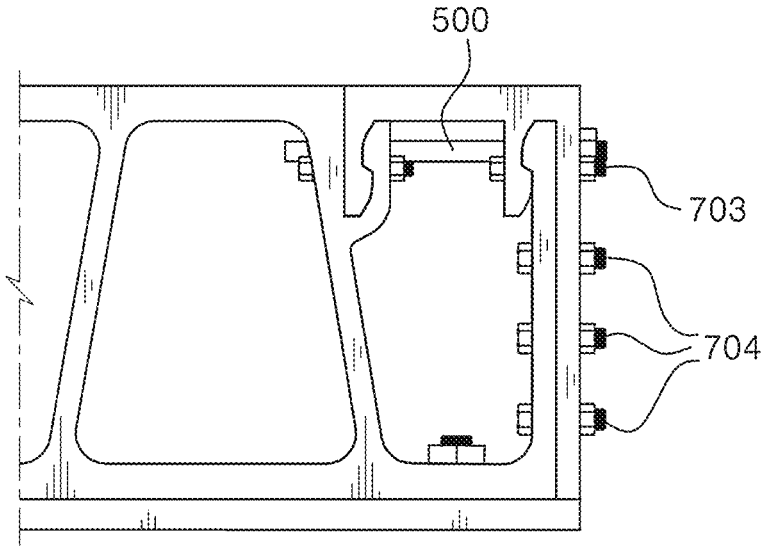
FIG. 31 is an enlarged partial front view showing all the connected states in the end panel of the present invention, including the connections of panel to supporting member and panel to panel.

The end panel further comprises a downward interlocking protrusion 331 at the bottom end of the downward outer projected portion 330 and the downward inner projected portion 340, and a concave downward inverted U-shape 342 formed between the downward inner projected portion 340 and outer web 320 of the end panel, to provide concavo-convex interlocking snap-fit connections with the end panel 300 and the neighboring main panel 100 as shown in FIG. 31.

Further, a plurality of web-bolt holes 323 are formed in the vertical direction in the downward outer projected web 320 at the transverse edge of the end panel 300, to connect neighboring main panel 100 with web-bolts 704 as shown in FIG. 31.

In addition to above, an anchorage hole 321 at the upper portion of the outer web 320, a slit 332 in the outer projected portions 330, and another slit 343 in the inner projected portions 340 of the end panel 300 are formed, respectively, wherein these are located in the coincident line with corresponding anchorage hole 152, the slit 173, and another slit 163 of the main panel 100, to provide common space for end-tensioning member 500 to get through when the end panel 300 is connected with the main panel, as shown in FIG. 31.

Further, a lock-bolt hole 333 in the outer projected portion 330, another lock-bolt hole 344 and the other lock-bolt hole 322 in the inner projected portion 340 are formed, respectively, at the end panel 300, in the coincident line with corresponding lock-bolt hole 152, another lock-bolt hole 174 next to it, and the other lock-bolt hole 164 of the main panel 100, to fasten the lock-bolts 703 in the snap-fit connected portions as shown in FIG. 31.

Tensioning Member 400

FIGS. 22A to 24 are different views and progressive steps of a tensioning member 400 of the present invention, which interconnects and pre-tensions the main panels 100 that are placed side by side. In FIG. 24B, it shows both side of tensioning rods are rotated in 90° from the state of FIG. 24A to ensure the heads of them to be anchored, and tensioning rods are met each other to start tensioning. In FIG. 24C, it shows tensioning state by pulling the tensioning rods with each other through the coupler;

The tensioning member 400 is anchored at the outermost inner web of each main panel placed side-by-side and passes through the slit and the anchorage hole which are formed in the outermost inner web and upward outer web of the main panel 100, and exerts pre-tensioning force in-between the two main panels 100.

As shown in FIGS. 22A to 24C, the tensioning member 400 comprises a first tensioning rod 410, a second tensioning rod 420 and a coupler 430. In more detail, the first tensioning rod 410 comprises a first anchorage head 411 and a first threaded part 412, and the second tensioning rod 420 comprises a second anchorage head 421 and a second threaded part 422.

Figure 34:
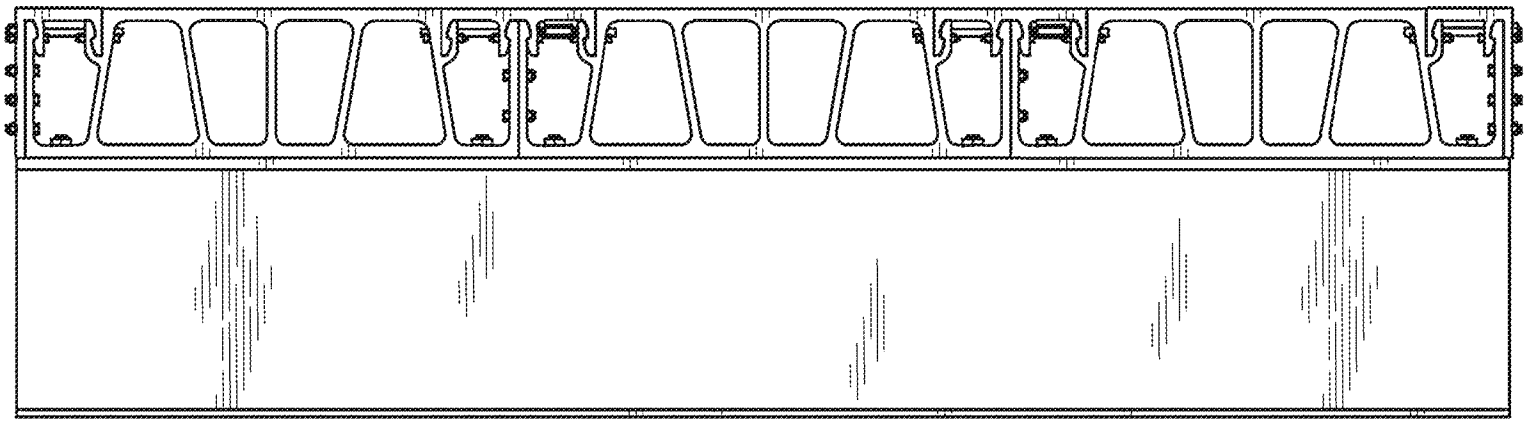
FIG. 34 is a front view of connected panels of the present invention corresponding to FIG. 33.
Figure 35:
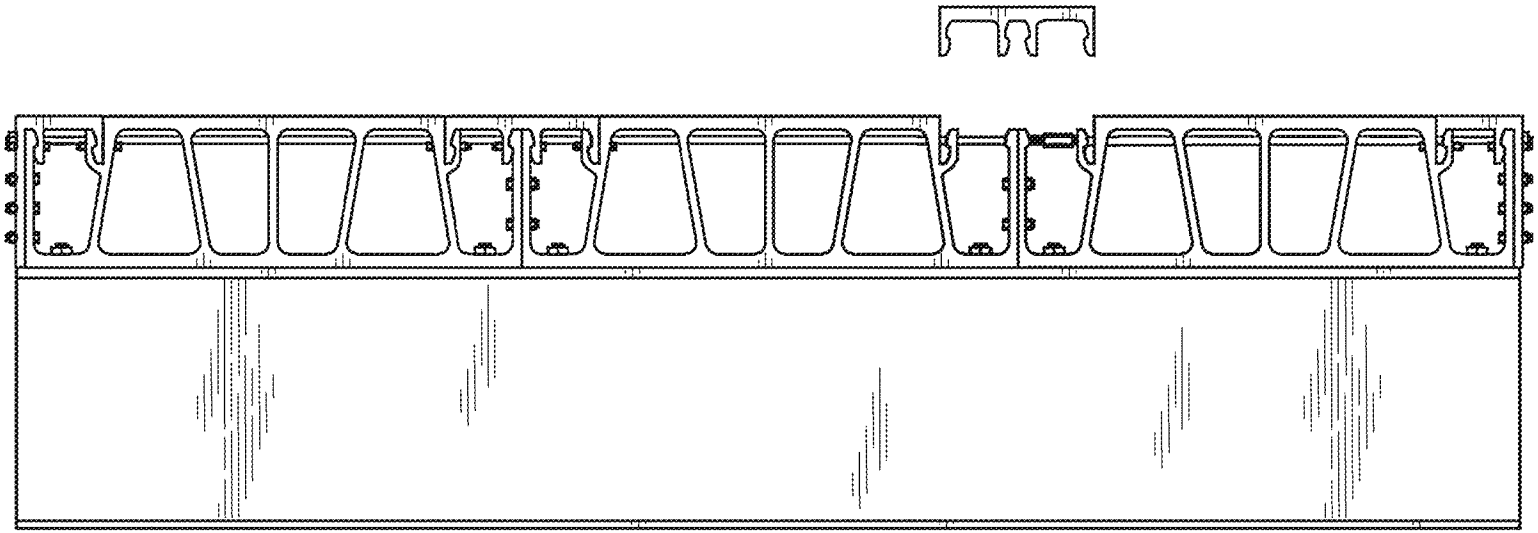
FIGS. 35 and 36 are front views of connecting panels, showing connections are made with the tensioning member of longer length, according to another embodiment of the present invention, respectively.
Figure 36:
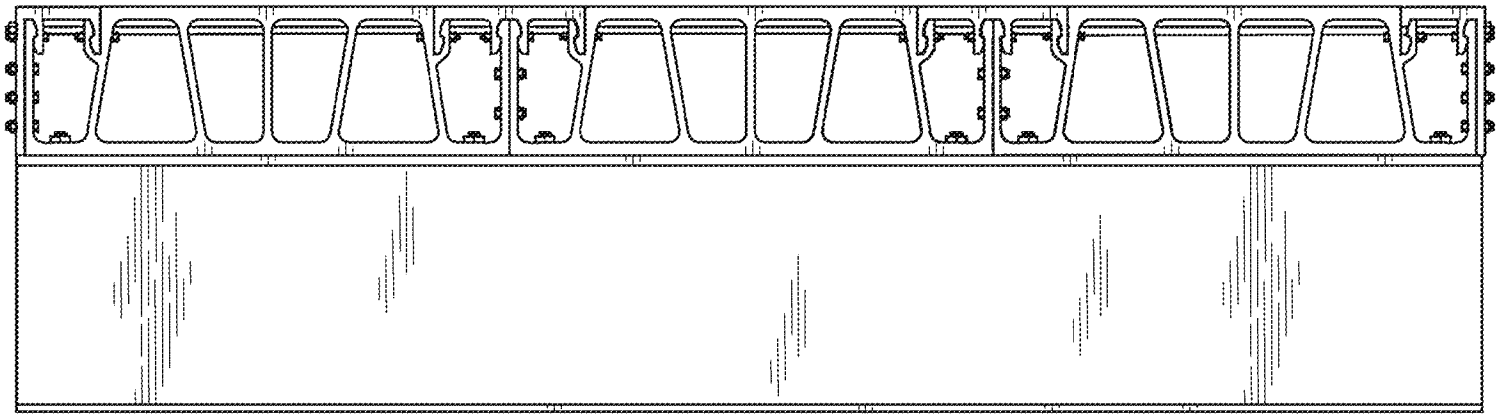

As shown in FIGS. 35 and 36, the tensioning member can be extended to pass through several connected panels, to exert pre-tensioning force between them at a time, in contrary to the case of tensioning in every connected portion at each time, as shown in FIGS. 33 and 34. Consequently, number of tensioning connections can be adjusted if necessary, by altering the length of tensioning member and changing the corresponding slits to pass holes in the main and cover panels, according to other embodiments of the present invention.

End-Tensioning Member 500

Figure 32:
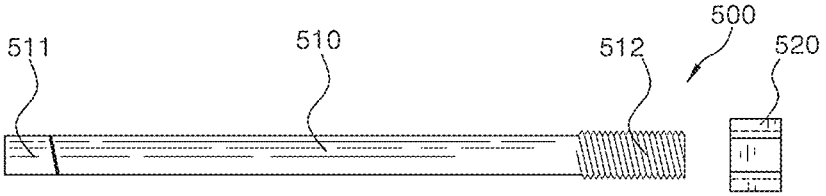
FIG. 32 is a front view of end-tensioning member of the present invention.

FIG. 32 is a front view of an end-tensioning member 500 of the present invention, interconnecting the main panel and the end panel, and exerting pre-tensioning force between them. As shown in FIG. 32, the end-tensioning member 500 comprises a third tensioning rod 510 and a nut 520. In more detail, the third tensioning rod 510 comprises a third tensioning rod 510 and a nut 520 in the end-tensioning member, wherein the third tensioning rod comprises a third anchorage head 511 and a third threaded part 512.

Hereinafter, procedure of connecting the panels over the supporting member 600 using the main panel 100, the cover panel 200, the end panel 300, the tensioning member 400 and the end-tensioning member 500 will be disclosed in more detail.

Connection of the Main Panel 100 and the Supporting Member 600

Figure 15:
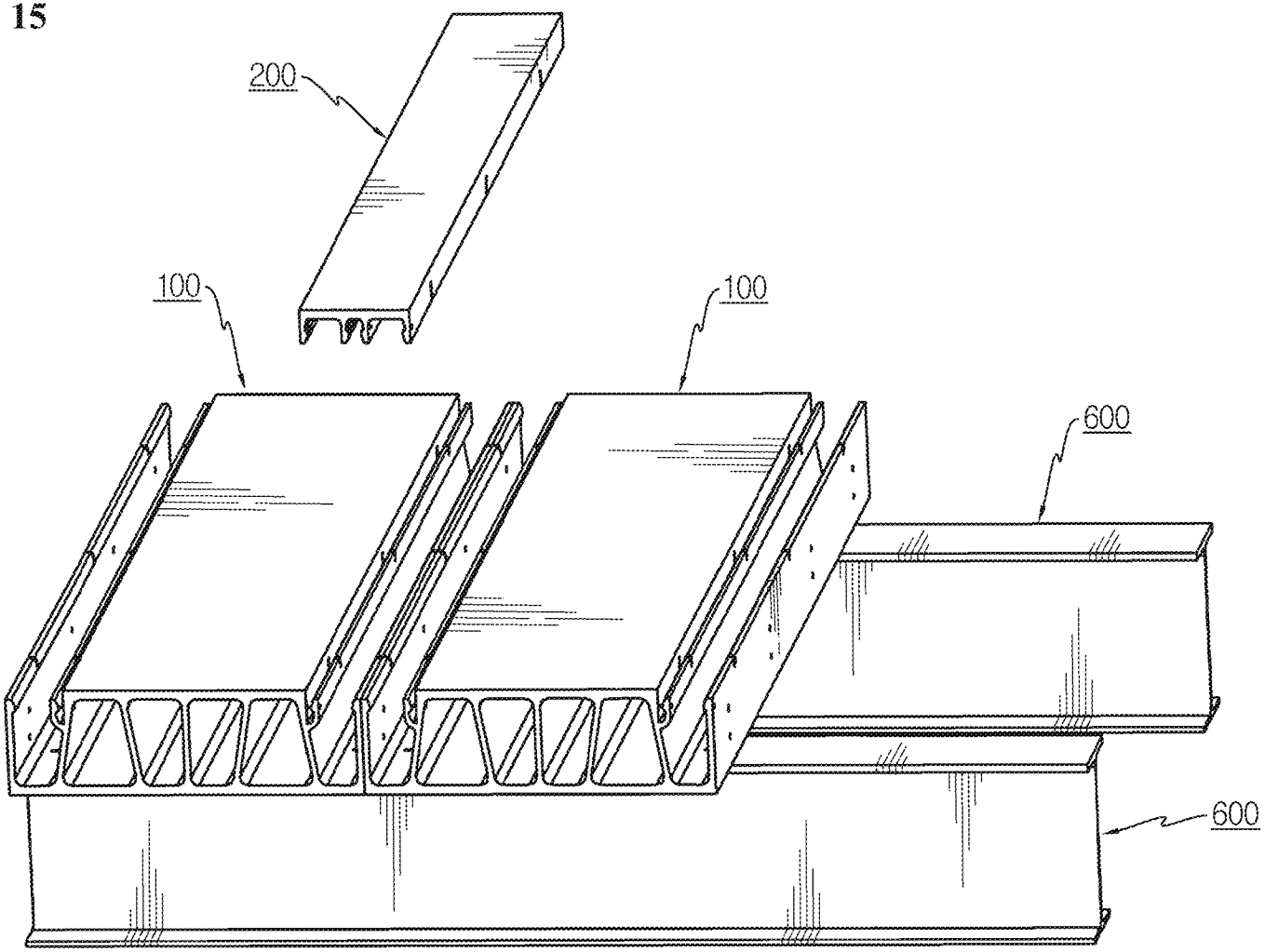
FIGS. 15 and 16 are a perspective view and cross-sectional view, respectively, showing state of assembling the main panel and the cover panel of the present invention.
Figure 16:
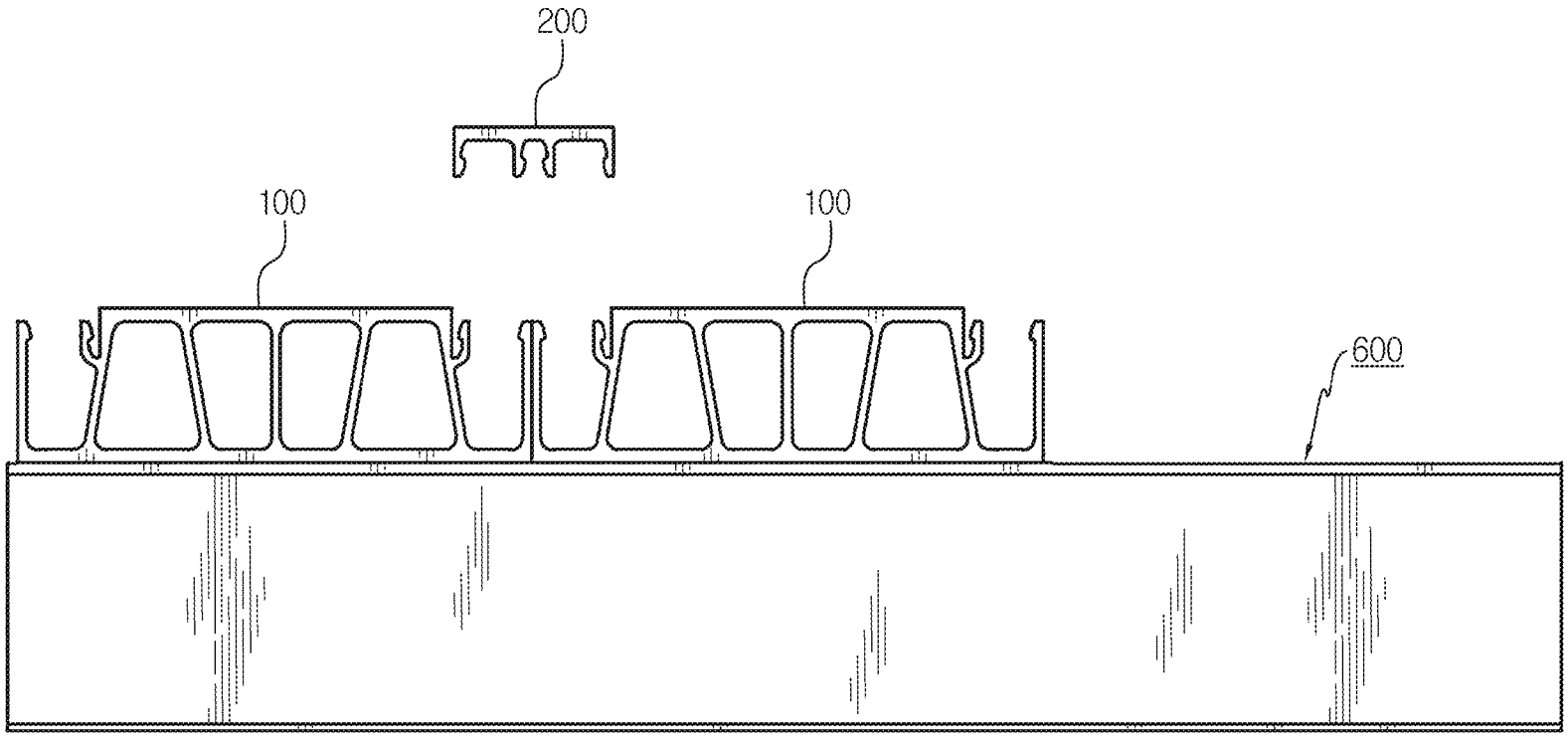

FIGS. 15 and 16 are a perspective view and a cross-sectional view, respectively, showing the state of assembling the main panel 100 and the cover panel 200 of the present invention.

As shown in FIGS. 15 and 16, the main panels are placed in the transverse direction over the supporting member 600*s*, which are installed in longitudinal direction in priori, and thereafter they are connected onto the supporting members at every crossing spots with each other. This connection is made with the stud-bolt 701 through the stud-bolt hole 131, as shown in FIG. 17, to resist shearing forces between panel and supporting member. The stud-bolt can be either pre-welded at supporting member or be welded to supporting member at the site with stud gun. In a following step, succeeding main panel is consecutively connected, in the same manner as before, onto the supporting member right next to the preceding main panel, with their upward outer webs 160 contacted with each other.

Figure 38:
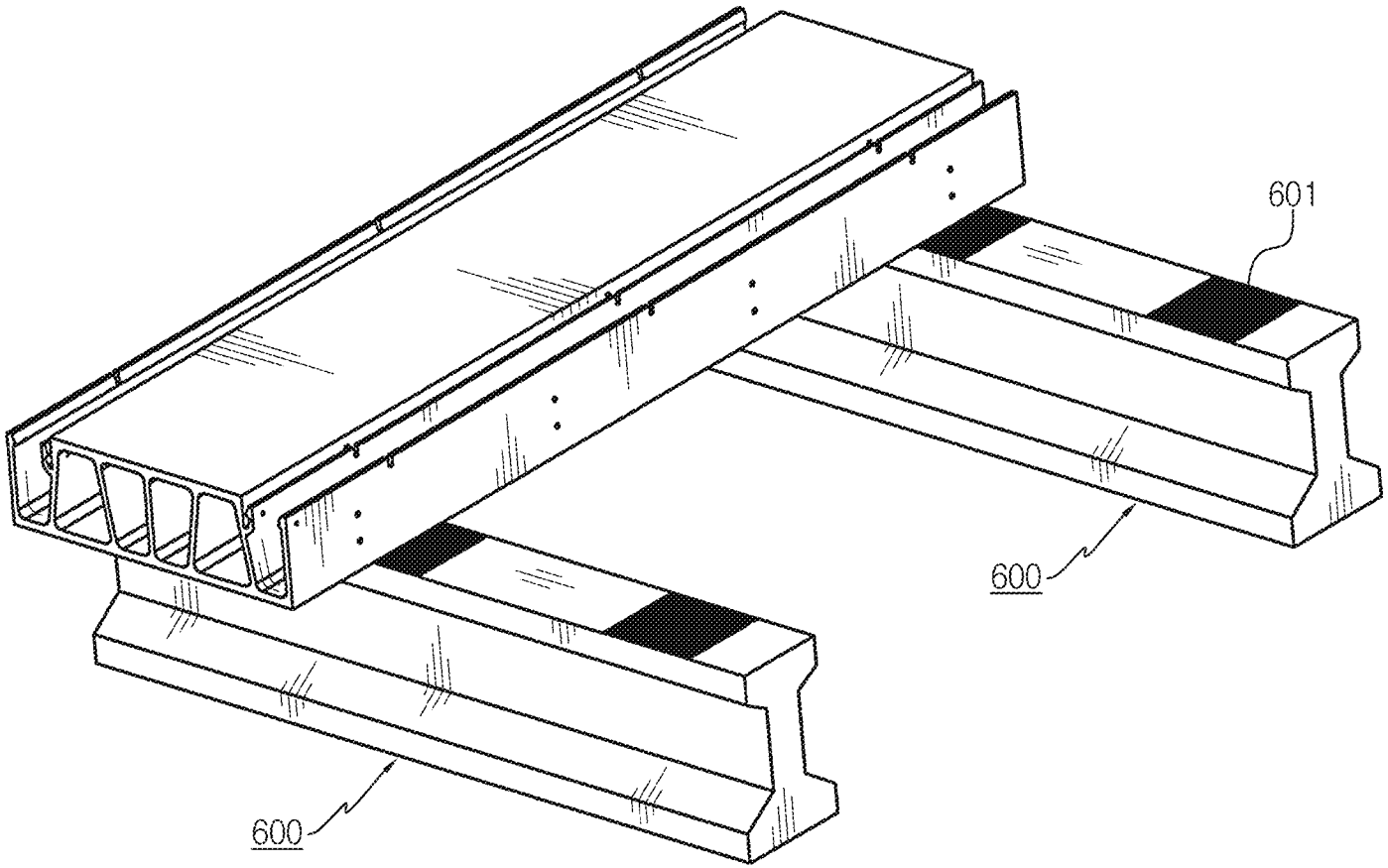
FIG. 38 is a perspective view showing, the supporting member can be concrete girder, on which anchor plates are formed over the connecting portions with stud-bolts, according to other embodiments of the present invention.

As stated before, the supporting member 600 can be made with any materials including but not limited to steel and concrete. In case of concrete, to weld the stud-bolt as the way in the steel, an anchor plate 601, preferably made with steel, can be formed integrally with concrete at the top side of the supporting member in the location of the stud-bolt connection, as shown in FIG. 38, according to other embodiments of the present invention.

In this illustration, 3 consecutively connected panels are shown, but needless to say, if necessary, more panels can be consecutively connected, according to other embodiments of the present invention.

Connection Between the Main Panels 100 with the Web-Bolt 702

Figure 25:
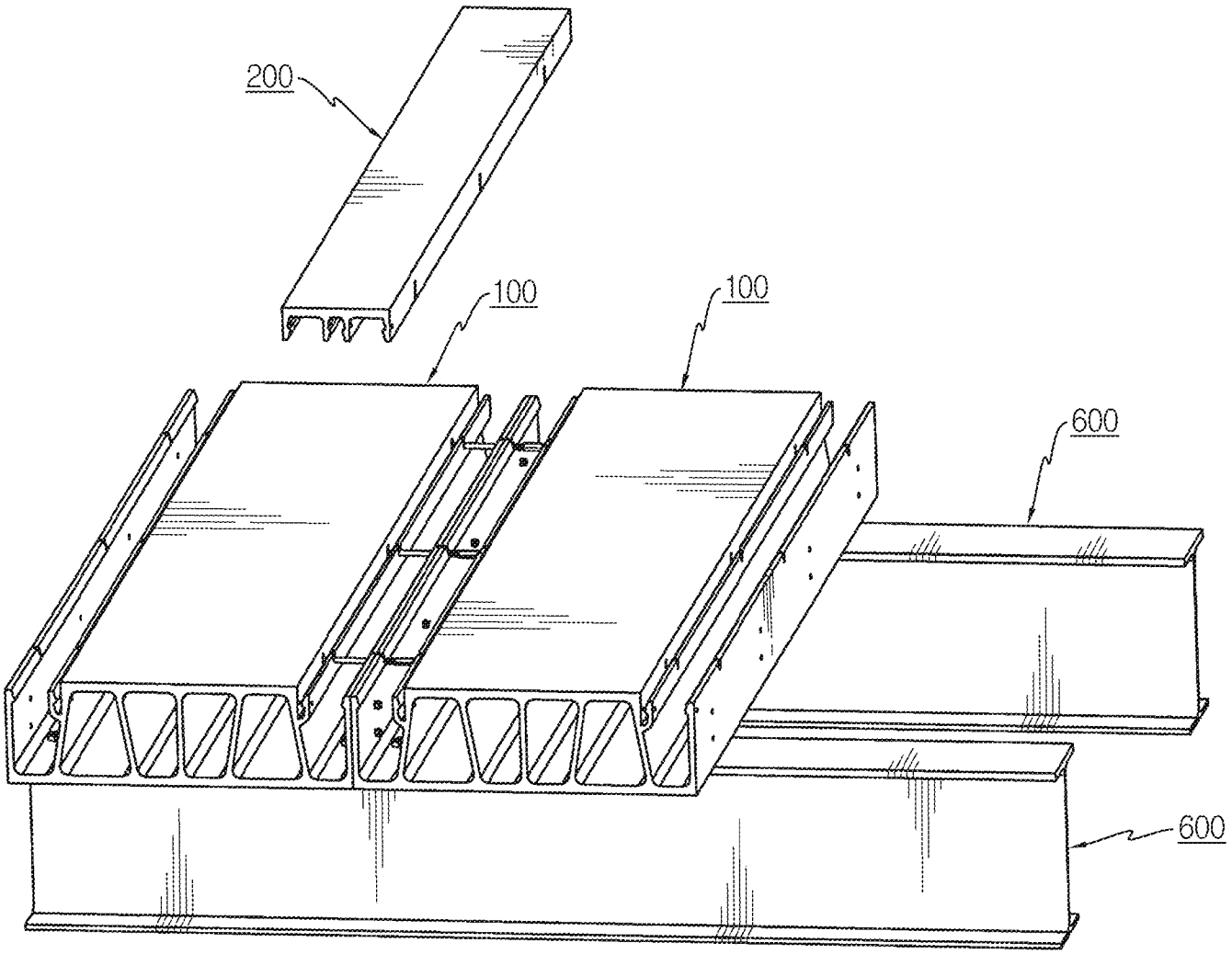
FIGS. 25 to 28 are views showing installation steps of the present invention, respectively.
Figure 26:
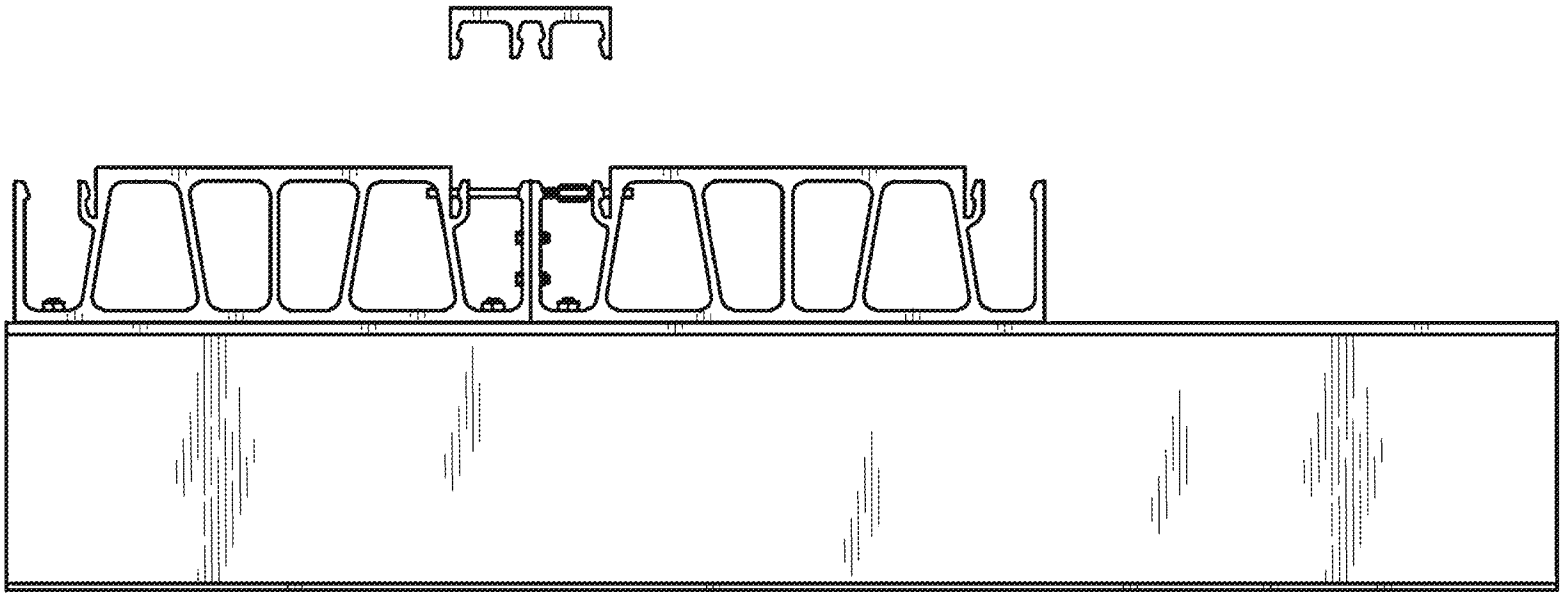
Figure 27:
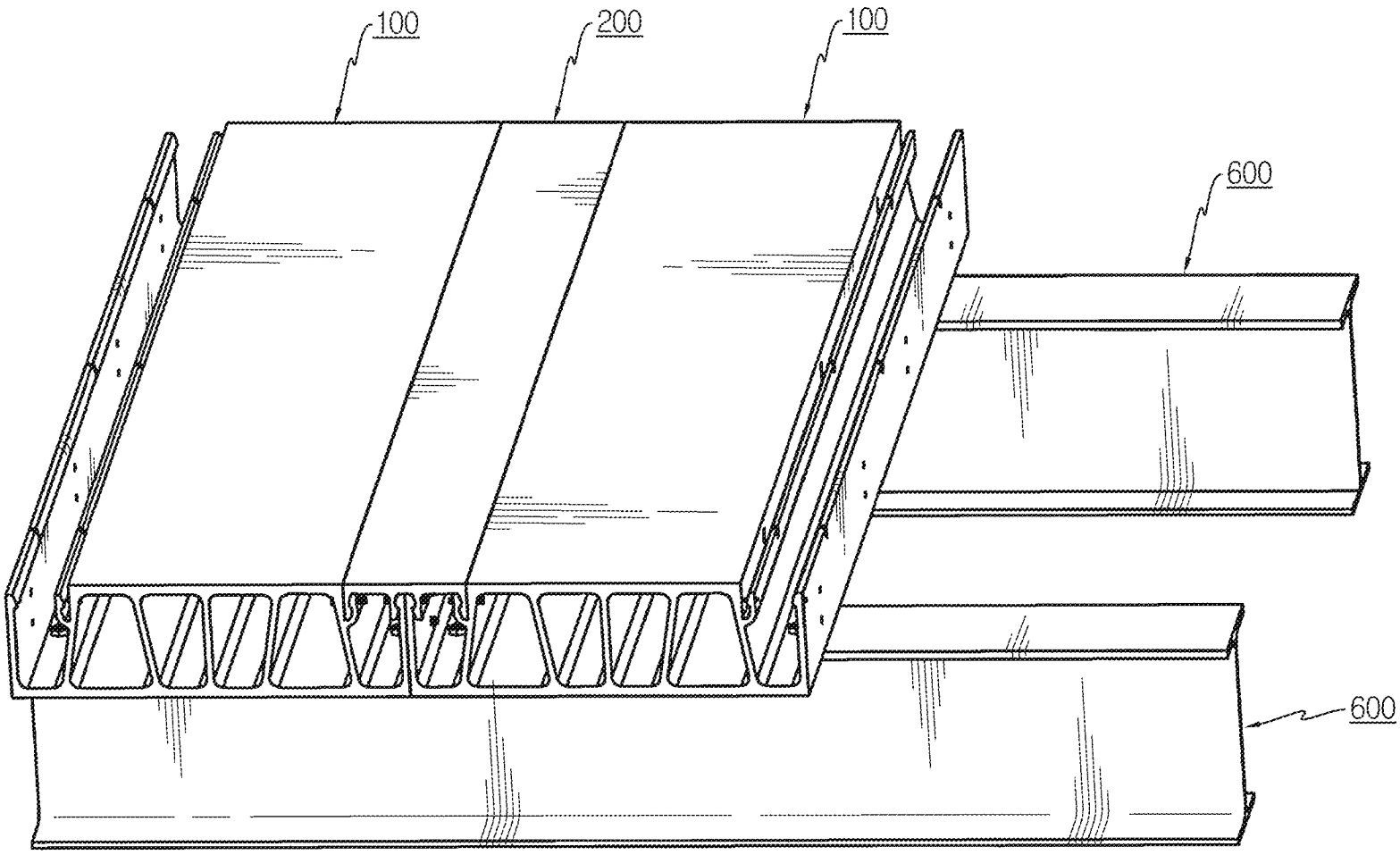
Figure 28:
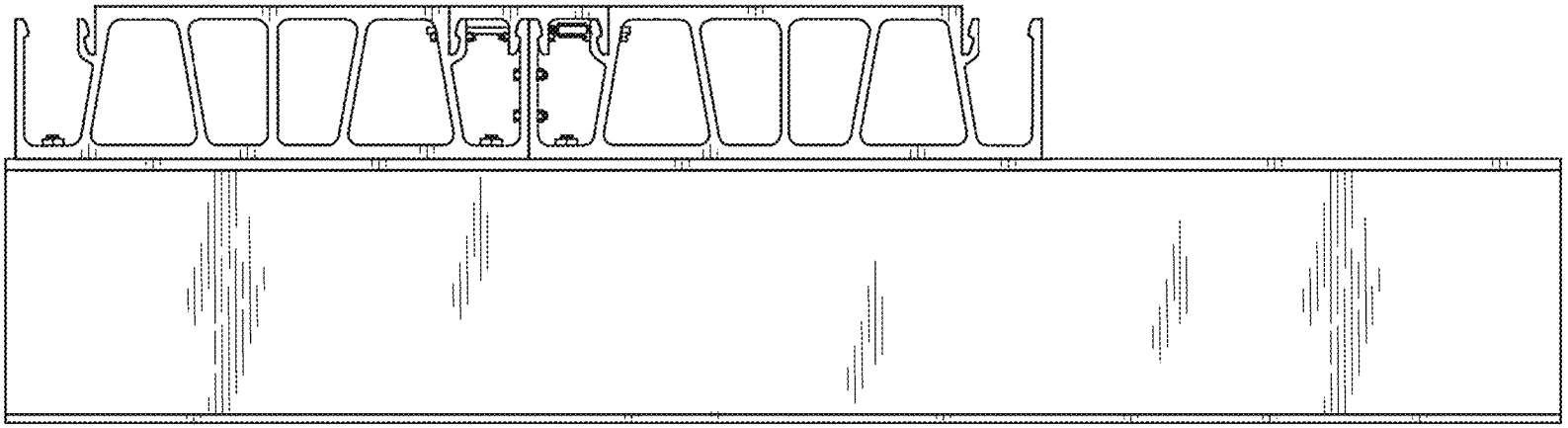

Following the connection of the neighboring main panels 100 to the supporting member with the stud-bolts 701, subsequently, the closely contacted upward outer webs 160 of the panels are connected with each other with web-bolts 702 in the vertical and horizontal directions, as shown in FIGS. 18, 25 and 26.

In the next phase of assembly, open-sectional portions of the main panels, with connected outer webs at middle, are interconnected with the cover panel through the concavo-convex connection with each other, consequently, formed in a structurally stable closed-sectional shape. The web-bolts 702 in the connected outer webs 160 of this closed-sectional shape effectively resist tensile force, induced from positive bending moment with concave upward deflection, exerted at the lower side of the panel, thereby preventing gap opening and disconnection at lower portion of connected panels. The connected web-bolts resist shearing and twisting forces as well. With all these effects, web-bolt connection is considered to play a part for enhancing structural performance of connected paneled structure to be comparable with seamless tubular plate structure manufactured integrally at a time.

The web-bolt connection in an open-sectional portion of the present invention resolves the problem of the prior art in FIG. 1, wherein the prior art cannot provide space for worker's hand to carry bolting works since the closed-sectional shape is immediately formed by snap-fit connecting the succeeding panel over the lower extended portion of the preceding panel, without providing sequence for bolting each other.

Pre-Tensioning with the Tensioning Member 400

Following the connections with the stud-bolts 701 and the web-bolts 702 for the main panel 100, subsequently, pre-tensioning force is exerted between the connected panels with the tensioning member 400 at upper portions of both panels in longitudinal direction, as shown in FIGS. 19 to 26.

Figure 24A:
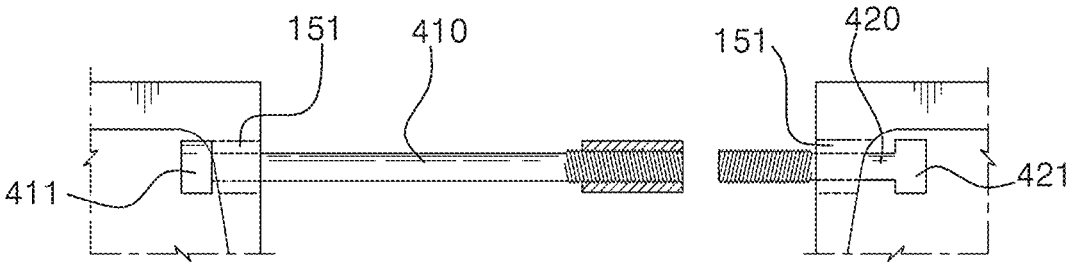
FIGS. 24A, 24B and 24C are cross-sectional view showing progressive steps of the tensioning of tensioning member of the present invention, respectively.
Figure 24B:
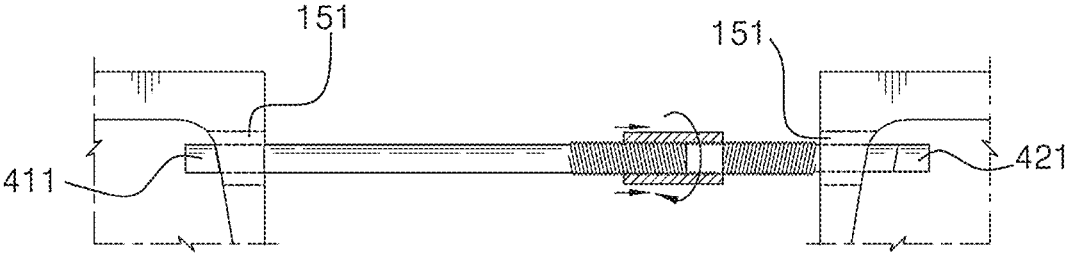
Figure 24C:
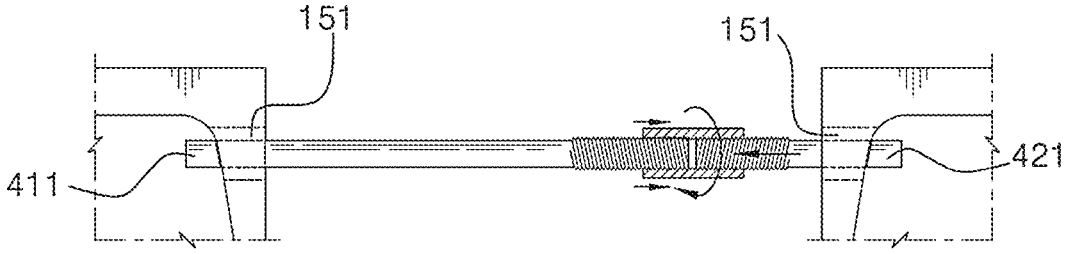

As shown in FIG. 25, tensioning members 400 are installed throughout the width of connected main panels 100 with certain intervals in transverse direction, and by passing through the upper portions of the connected panels. To begin with installation, the first tensioning rod 410 and the second tensioning rod 420 are inserted downward through the slit 163 in the upward outer web 160 and the other slit 173 in the interlocking protrusion 170 of the outermost inner web 150 of the each main panel, respectively, as shown in FIGS. 19 and 24A. Thereafter the first anchorage head 411 is anchored at the anchorage hole 151 in the outermost inner web of one out of two main panels which are placed side by side, and the second anchorage head 421 is anchored at the anchorage hole 151 in the outermost inner web of the second of the main panels which are placed side by side. The anchorage hole 151 is formed with height to be greater and with width to be less than those of the head of tensioning rod. By this way, the first and second head 411, 421 will be anchored at inner side of the outermost inner web 150 of the anchorage hole 151, when they are rotated in 90° after passing through the anchor hole 151, as shown in FIGS. 22A and 22B and FIGS. 24A to 24C. Thereafter the tensioning rods are combined with each other and exerted tensioning forces between the main panels. As the threaded screw direction of the first threaded part 412 in the first tensioning rod 410 is in reverse direction of the second threaded part 422 in the second tensioning rod 420, and accordingly, by rotating the coupler 430 in clockwise after the threaded parts of both tensioning rods are placed within the coupler, the gap between the two threaded parts is narrowed, as shown in FIGS. 20, 23A and 23B and FIGS. 24A to 24C, leading to tension between the main panels.

In the next phase of assembly, connected and pre-tensioned open-sectional portions of the main panels 100 are interconnected with the cover panel 200 through the concavo-convex interlocking connection with each other, and consequently, transforming them to structurally stable closed-sectional shapes.

The tensioning member 400 of this closed-sectional shape effectively resist tensile force, induced by negative bending moment with concave downward deflection, exerted at the upper side of the panels, thereby not only preventing gap opening and disconnection at the upper portion of the connected panels, but also increasing load carrying capacity of connected panels. In addition, the tensioning members 400 of the present invention, placed in the longitudinal directions, are blocking the transverse sliding movement of snap-fit connected cover panel, thereby preventing disconnections in transverse direction between main panels 100 and cover panel 200. Further, with pre-tensioning, the surface of the connection will be in plane-smooth condition without raised bump, preventing pavement cracks in the direction perpendicular to driving, thereby improving the riding comfort as well, when the panel used in a bridge deck. With these effects, pre-tensioning at the connection is considered to play a part for enhancing structural performance of connected panels to be comparable with whole integral structure.

Figure 2:
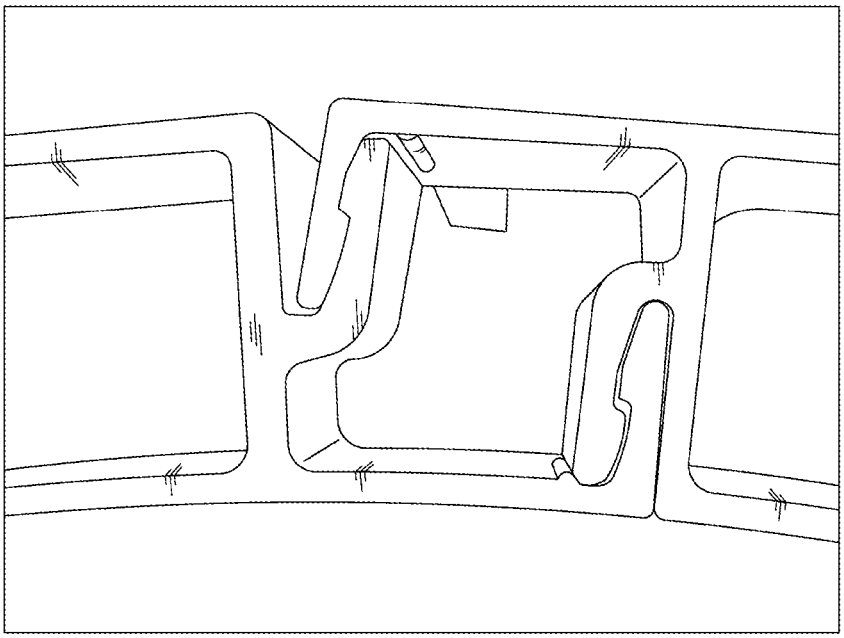
FIG. 2 is a photo taken during experiments of asymmetric deck of the prior art, showing large gap opening at snap-fit connected portion due to excessive bending moment.
Figure 3:
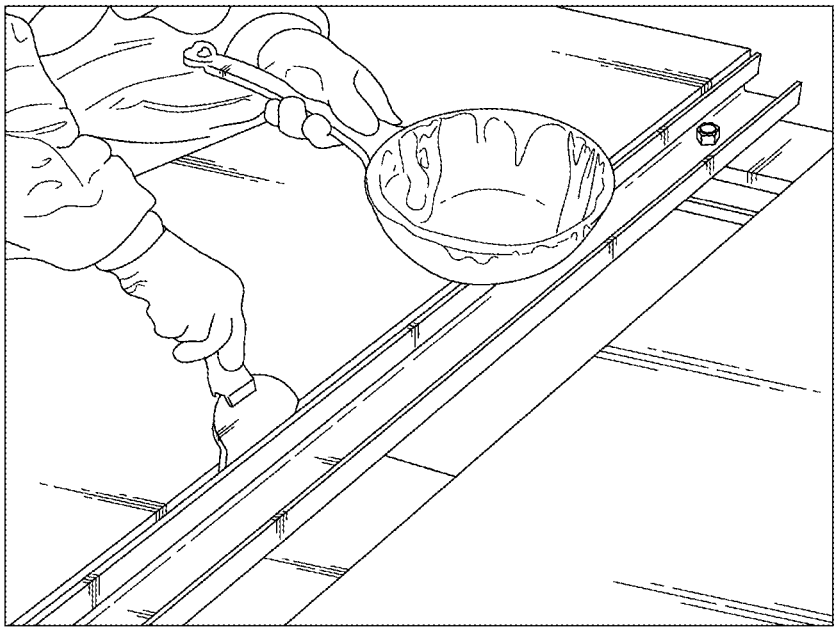
FIG. 3 is a photo taken during site installation of asymmetric deck of the prior art, showing applying adhesives to prevent gap opening and disconnection of panels at snap-fit connected portion.

Pre-tensioning the connected panels with tensioning member 400 of the present invention, preventing gap opening and disconnection at connection portion, effectively resolves the problem of gap opening of the prior art as shown in FIG. 2.

Connection with the Cover Panel 200

Following the connections with the stud-bolt 701, the web-bolts 702 and the tensioning member 400 for the main panel 100, subsequently, the cover panel 200 of the present invention is concavo-convex snap-fit connected to the neighboring main panels at connection portions of open-sectional shape, consequently, transforming to integral closed-sectional shape throughout the connection, as shown in FIGS. 25 to 28.

Detailed configurations for concavo-convex interlocking snap-fit connection formed in the main panel 100 and cover panel 200 of the present invention are stated before and will not be repeated herein, instead the procedure of the connection will be described hereinafter.

As shown in FIGS. 11A and 11B, and FIGS. 12, 15 and 16, the cover panel 200 is snap-fit connected progressively by interlocking the corresponding concavo-convex portions, made in the main panels and the cover panel, respectively. When two main panels are placed side-by-side, the downward interlocking protrusion 221 at the lower end of the downward outer projected portions of the cover panel 200 and the concave upward U-shape 172 in-between the outermost inner web and upward projected portion of the main panel 100 are coupled and interlocked with each other, and at the same time, the two adjoining upward interlocking protrusions 161 at the upper end portion of the outer web 160 of the main panels and the concave downward inverted U-shape 234 created between the two downward inner projected portions of the cover panel 200 are coupled and interlocked with each other, collectively forming three simultaneously interlocking concavo-convex snap-fit connections at a time, whereby the open-sectional portions of the two neighboring main panels are transformed into structurally stable closed-sectional shapes after their connection with the cover panel.

Figure 11C:
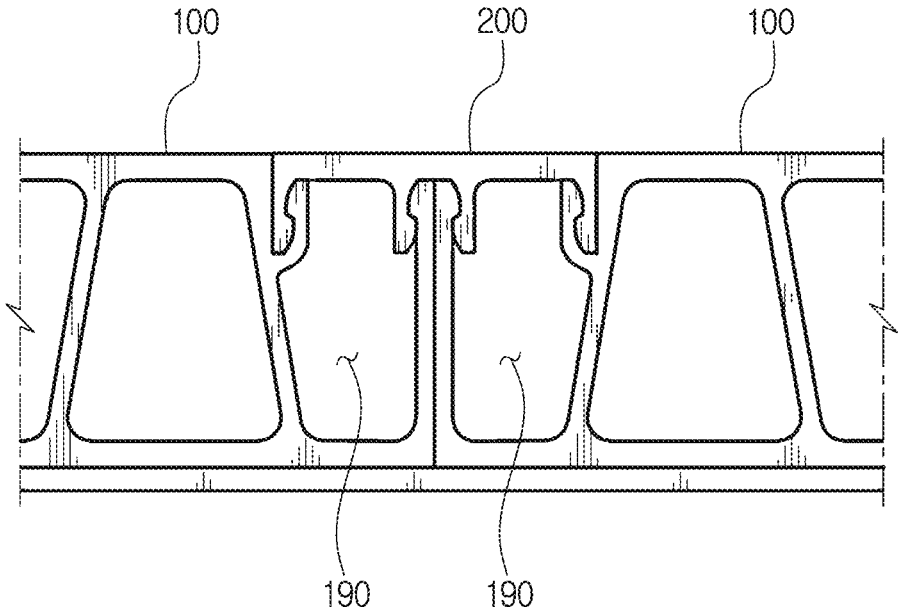

When the cover panel 200 of the present invention is pressed down to the connection portion, the upward U-shape 172 in-between the outermost inner web and upward projected portion of the main panel 100 and the concave inverted U-shape 234 in-between the two inner projected portions of the cover panel expand slightly in the course of inserting the corresponding interlocking protrusions, and thereafter immediately retract back to its original shape to restore its original configurations based on elastic characteristics, exhibiting a snap-fit action, which is predominant feature for the preferable material of fiber reinforced composites, subsequently leading to a mechanically coupled and interlocked, yet detachable, state of concavo-convex snap-fit connection, as shown in FIG. 11C.

When the corresponding portions are completely coupled and interlocked to each other, as shown in FIG. 11C, the interlocking protrusions of elongated S-shape are closely matched with corresponding inverted interlocking shape formed inside of U-shape and inverted U-shape, thereby the interlocked and snap-fit connected portions will not come apart under certain level of pull-out force.

Due to the elongated S-shape of the interlocking protrusion, the connected portions can be pulled out in the order reverse to the connection. Accordingly, when pull-out force beyond certain level is exerted in upward direction, the cover panel 200 can be taken out, thereby lead to disassembly of each of the connected panels.

In the above, the mechanism of interlocking snap-fit connection between cover panel and neighboring main panels is described in detail, however, as stated before, the tensioning member 400 is installed prior to the interlocking snap-fit connection. The slits 222 and 232 formed in the downward outer projected portions and the downward inner projected portions of the cover panel 200 and the slits formed in the outermost inner web and upward outer web of the main panel 100 play a part to accomplish smooth concavo-convex connections between the main panels and cover panel without interfering with the longitudinal tensioning member 400 which is located across the connected portions before the concavo-convex connections are interlocked, as shown in FIG. 21. With this tensioning member 400, installed in the longitudinal direction, sliding movement of the cover panel in the transverse direction can be blocked, thereby effectively preventing disconnection of connected panels in transverse direction, while the prior art in FIG. 1 does not provide any mechanical means of preventing such disconnection.

Connection with the Lock-Bolt 703

Following the connections with the stud-bolts 701, the web-bolts 702, the tensioning member 400, and the concavo-convex interlocking snap-fit, subsequently, the lock-bolts 703 are connected at the snap-fit connected portions of the main panels 100, as shown in FIGS. 27 to 31, consequently, with these lock-bolt connections, the open-sectional portions of the main panels are transformed to even more firmly connected closed-sectional shape throughout the connected panels, as shown in FIGS. 25 to 28.

Detailed configurations of lock-bolt holes for lock-bolt 703 connections of the present invention are stated before and will not be repeated herein.

As shown in FIGS. 27 to 31, the lock-bolts 703 are fastened at the lock-bolt holes, formed in every snap-fit connected portions of the main panels 100. Accordingly, with such lock-bolt connections, gap opening and disconnections of connected panels in vertical and transverse directions are further prevented, thereby overcoming the related problems of the prior art.

Connection with the End Panel 300

Following the connections with the stud-bolts 701, the web-bolts 702, the tensioning member 400, the snap-fit connection by cover panel 200, and the lock-bolts 703 for the main panel 100, subsequently, the end panels are connected and pre-tensioned at beginning and ending portion of the connected panels to form entire connected panels in a closed-sectional shape, as shown in FIGS. 4, 31, 33 and 34.

In the first stage of the end panel 300 connection, the third anchorage head 511 is anchored at an anchorage hole 151 in the outermost inner web 150 of the main panel 100, and the third tensioning rod 510 passes through slits formed in the downward outer projected portions and the downward inner projected portions of the end panel and the upward projected portion and the outer web of the main panel, passes through the anchorage whole 321 in the outer web of the end panel, and the nut 520 is tightened to the third threaded part at exterior part of the end panel to exert pre-tensioning force between the main panel 100 and the end panel 300 to prevent gap opening and disconnection at the beginning and end portions of an assembled paneled structure.

Following the connection of end-tensioning member, thereafter the end panel is concavo-convex snap-fit connected with the main panel, where the downward interlocking protrusion 331 and 341 at the bottom end of the downward outer projected portion 330 of the end panel 300 and the upward U-shape 172 in-between the outermost inner web 150 and upward projected portion 170 of the main panel 100 are coupled and interlocked with each other, and at the same time, the upward interlocking protrusion 161 at the upper end portion of the outer web 160 of the main panel 100 and the concave downward inverted U-shape 342 formed between the downward inner projected portion 340 and the outer web 320 of the end panel 300 are coupled and interlocked with each other, collectively forming two simultaneously interlocking concavo-convex snap-fit connections at a time, subsequently, forming an assembled paneled structure in which the open-sectional portion of the main panel 100 are transformed to closed-sectional shape after its connection with the end panel 300.

With all of the various connective means, as described above, for the main panel 100, the cover panel 200 and the end panel 300, the completely assembled paneled structure turns to the paneled structure with closed-sectional shape throughout, so that the connected paneled structure of the present invention is considered to possess structural performance comparable to seamless tubular plate structure manufactured integrally at a time.

Each of the connected panels can be disassembled and taken apart in the order exactly reverse to the connections and pre-tensions described above, for the purpose of replacing, repairing, and reusing it in the later time, according to other embodiments of the present invention.

Fiber reinforced composites, having characteristics of light-weight, high-strength, high-durability and quick-restoration, can preferably be used in the main panel, cover panel and end panel of the present invention, benefitting to substitute steel for preventing corrosion, or concrete for preventing deterioration and rebar-rust.

In the consequences, the connected paneled structure in the present invention turns to 2-way plane plate structure, wherein each panel is manufactured seamlessly and integrally in the transverse direction in tubular cross-sectional form, and connected consecutively with various connective means in longitudinal direction, forming closed-sectional shape throughout. By forming such a 2-way plate structure, the connected paneled structure of the present invention resists bi-axial bending moments more effectively by distributing stresses in two directions, whereby provides well better structural performance with increased load carrying capacity compared to the connected panels of the prior art in FIG. 1.

When the paneled structure of this invention is used as a bridge deck, it effectively resists bending moments, shearing forces and twisting forces in bi-axial directions, induced by self-weight, vehicle loads and wind loads. In addition, the panels of the present invention, connected integrally in longitudinal direction, provides increased riding comfort with smooth surface without raised bump and prevents pavement cracks in the direction perpendicular to driving.

The use of paneled structure of the present invention does not limited to the bridge deck as described above, but it should be understood to include all of the paneled ground structure adapted to civil, architectural and plant constructions, which are supported by any form of supporting member including but not limited to girder, beam, purlin or column.

Figure 40:
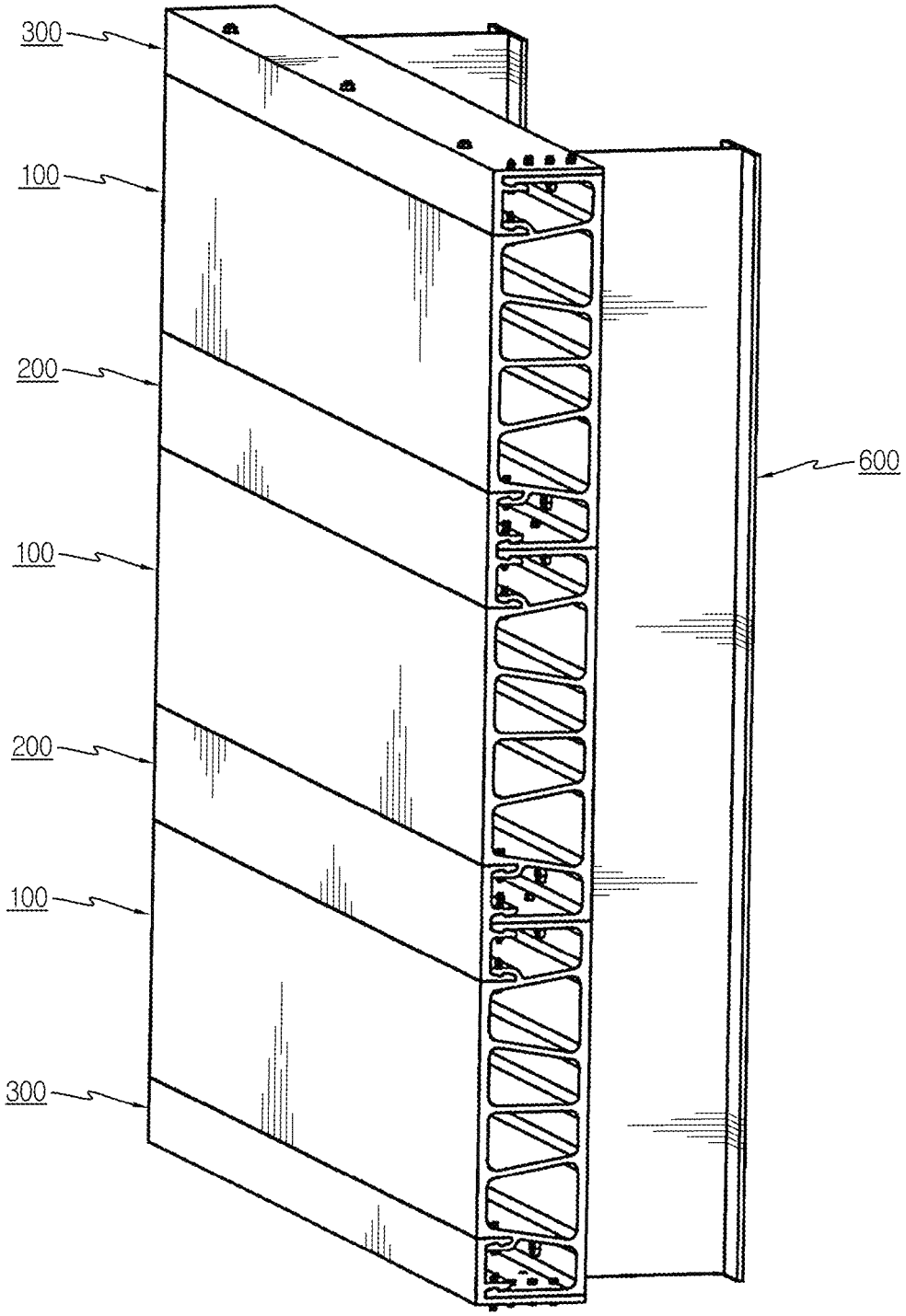
FIG. 40 is a perspective view showing the connected panel of the present invention is adapted to the wall structure by rotating it in 90°.
Figure 41:
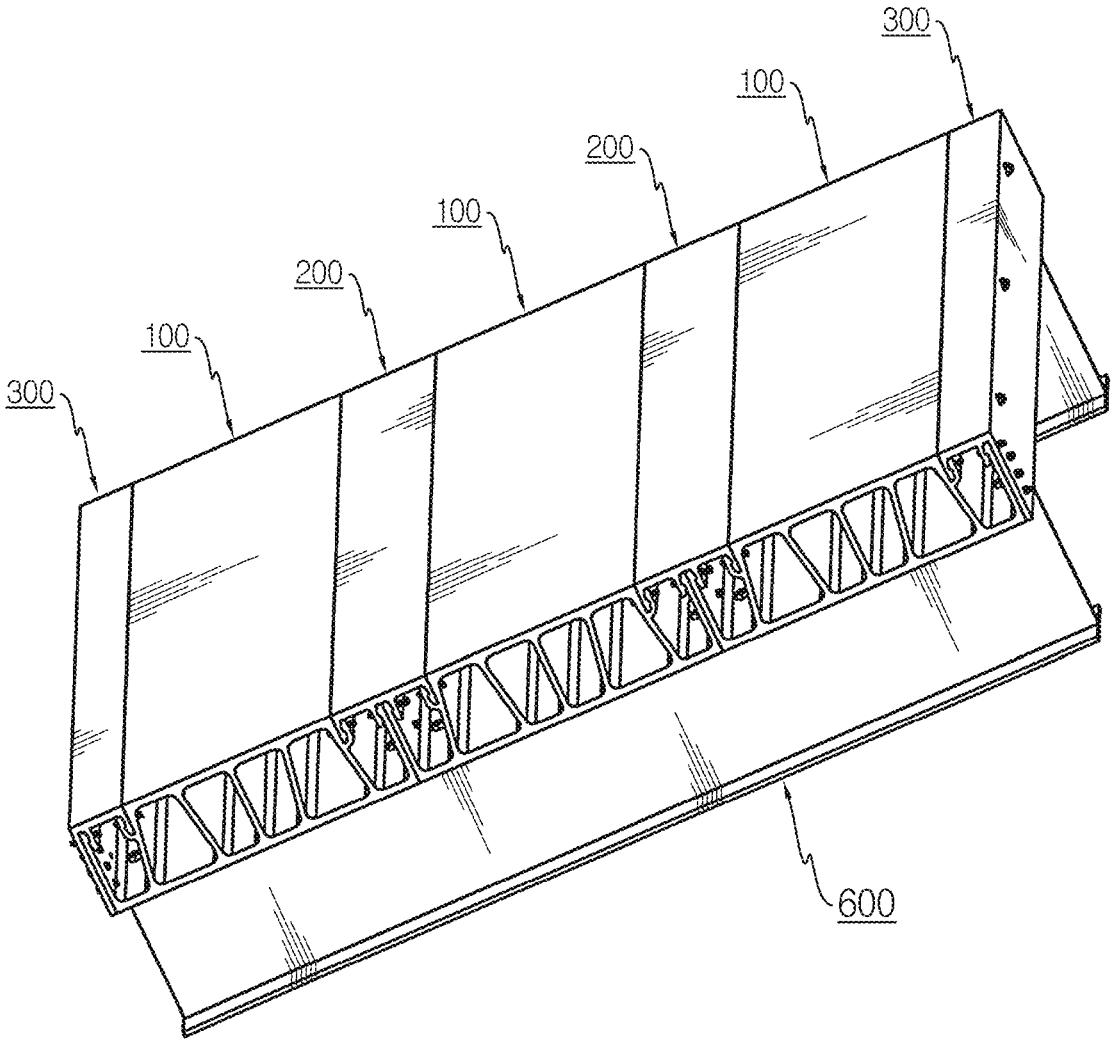
FIG. 41 is a perspective view showing the connected panel of the present invention is adapted to the roof structure by inclining it in certain degree.

The paneled structure of plane plate can be used in a bridge deck as stated above, and also in a floor deck of building, decks for platform and footway and other similar structures. FIGS. 40 and 41 show other variations of the present invention. As shown in FIG. 40, when the paneled structure of the present invention is rotated in 90°, it will be a wall structure to be adapted to various constructions such as the wall structures in building, subway, water treatment structure, port structure, off-shore structure, water gate, box culvert and so on. As shown in FIG. 41, when the paneled structure of the present invention is inclined with certain degree, it will be a paneled roof structure to be adapted to various constructions such as roof or cover structure in building, storage tank, arena and so on.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A modular paneled structure having connective means to prevent gap opening and disconnection, comprising each of the following:

a main panel with a symmetric profile which has a closed-sectional portion in the middle and open-sectional portions at each end, wherein the closed-sectional portion comprises an upper plate, a lower plate, and inner webs, connecting the upper and lower plates to form a plurality of divisional cells of polygonal tubular cross-sectional shapes between the upper and lower plates, wherein the open-sectional portion comprises an extended lower plate, an upward outer web at the end of the extended lower plate, and an outermost inner web which is shared in common with the closed-sectional portion;

a cover panel with a symmetric profile of an open-sectional portion which interconnects two side-by-side main panels, where the cover panel closes the open-sectional portions of the two side-by-side main panels, wherein the cover panel comprises an upper plate, two downward outer projected portions which each project from the upper plate at each end, and two downward inner projected portions in the mid-section of the cover panel in-between the outer projected portions which project from the mid-section of the upper plate; and a tensioning member which interconnects and pre-tensions the main panels that are placed side by side, wherein the tensioning member is anchored at the outermost inner web of each main panel placed side-by-side and passes through a slit and an anchorage hole which are formed in the outermost inner web and upward outer web of the main panel, and exerts pre-tensioning force in-between the two main panels, wherein the tensioning member can be re-tensioned if necessary upon disassembling the cover panel; and consequently, forms an assembled paneled structure with all these connective means.

2. The modular paneled structure according to claim 1, wherein the tensioning member comprises a first tensioning rod, a second tensioning rod and a coupler, wherein the first tensioning rod comprises a first anchorage head and a first threaded part, and the second tensioning rod comprises a second anchorage head and a second threaded part, wherein the first anchorage head is anchored at an anchorage hole in the outermost inner web of one out of two main panels which are placed side by side, and the second anchorage head is anchored at an anchorage hole in the outermost inner web of the second of the main panels which are placed side by side, and wherein the threaded screw direction of the first threaded part in the first tensioning rod is in reverse direction of the second threaded part in the second tensioning rod, and accordingly, by rotating the coupler after the threaded parts of both tensioning rods are placed within the coupler, the gap between the two threaded parts is narrowed, leading to tension between the main panels, which prevents gap opening and disconnection at upper connected portions of the main panels, and increases load carrying capacity of the connected modular paneled structure.

3. The modular paneled structure according to claim 1, wherein each downward outer projected portion of the cover panel has a downward interlocking protrusion at the lower end and a slit formed in the downward outer projected portion, where each downward inner projected portion of the cover panel has a downward interlocking protrusion at the lower end, forming a concave inverted U-shape in-between the two inner projected portions of the cover panel, and a slit formed in the downward inner projected portion, and where the main panel comprises an upward projected portion together with an upward interlocking protrusion at the end of such upward projected portion, formed at the upper outer side of the outermost inner web, subsequently forming a concave upward U-shape in-between the outermost inner web and upward projected portion, an upward interlocking protrusion at the upper end portion of the outer web of the main panel, a slit formed in the outermost inner web and upward outer web of the main panel, and an anchorage hole formed in the outermost inner web of the main panel, wherein when two main panels are placed side-by-side, the downward interlocking protrusion at the lower end of the downward outer projected portions of the cover panel and the concave upward U-shape in-between the outermost inner web and upward projected portion of the main panel are coupled and interlocked with each other, and at the same time, the two adjoining upward interlocking protrusions at the upper end portion of the outer web of the main panels and the concave downward inverted U-shape created between the two downward inner projected portions of the cover panel are coupled and interlocked with each other, collectively forming three simultaneously interlocking concavo-convex snap-fit connections at a time, wherein the upward U-shape in-between the outermost inner web and upward projected portion of the main panel and the concave inverted U-shape in-between the two inner projected portions of the cover panel expand slightly in the course of inserting the corresponding interlocking protrusions, and thereafter immediately retract back to its original shape to restore its original configurations based on elastic characteristics, exhibiting a snap-fit action, subsequently leading to a mechanically coupled and interlocked, yet detachable, state of concavo-convex snap-fit connection, wherein the slits formed in the downward outer projected portions and the downward inner projected portions of the cover panel and the slits formed in the outermost inner web and upward outer web of the main panel play a part to accomplish smooth concavo-convex connections between the main panels and cover panel without interfering with the longitudinal tensioning member which is located across the connected portions before the concavo-convex connections are interlocked, and wherein with all these connective means, the modular paneled structures form an assembled paneled structure in which the open-sectional portions of the two neighboring main panels are transformed into closed-sectional shapes after their connection with the cover panel.

4. The modular paneled structure according to claim 3, further comprising connective means with a web-bolt and a lock-bolt, wherein the main panels which are placed side by side are connected to each other at the two adjoining upward outer webs of the main panels with a plurality of web-bolts to resist tensile and shearing forces between the connected panels, and consequently, to prevent gap opening at the lower portion of connected panels, and wherein the snap-fit connected portion at the upper part of the outermost inner web of each of the main panels and the downward outer projected portion of the cover panel are tightened with the lock-bolt, and the snap-fit connected portion at upper part of the outer webs of the connected side-by-side main panels and the downward inner projected portions of the cover panel are tightened with the lock-bolt, to resist tensile and shearing forces between the connections and consequently, to further prevent gap opening and disconnection at the upper portion of an assembled paneled structure.

5. The modular paneled structure according to claim 1, further comprising an end panel to interconnect with the main panel at the beginning and ending portions of an assembled paneled structure.

6. The modular paneled structure according to claim 5, further comprising an end-tensioning member to exert pre-tensioning force between the main panel and the end panel at the beginning and ending portions of an assembled paneled structure.

7. The modular paneled structure according to claim 6, wherein the end-tensioning member comprises a third tensioning rod and a nut in the end-tensioning member, wherein the third tensioning rod comprises a third anchorage head and a third threaded part, and wherein the third anchorage head is anchored at an anchorage hole in the outermost inner web of the main panel, and the third tensioning rod passes through slits formed in the downward outer projected portions and the downward inner projected portions of the end panel and the upward projected portion and the outer web of the main panel, passes through the anchorage whole in the outer web of the end panel, and the nut is tightened to the third threaded part at exterior part of the end panel to exert pre-tensioning force between the main panel and the end panel to prevent gap opening and disconnection at the beginning and ending portions of an assembled paneled structure.

8. The modular paneled structure according to claim 5, wherein the end panel comprises an upper plate, a downward outer web which is perpendicularly connected with the upper plate at the end side, a downward outer projected portion projected from the other end of upper plate, a downward inner projected portion projected from the upper plate in-between the outer web and the outer projected portion, a slit formed in the downward projected portion, a slit formed in the downward inner projected portion, and an anchorage hole formed at the outer web of the end panel.

9. The modular paneled structure according to claim 8, wherein the end panel further comprises a downward interlocking protrusion at the bottom end of the downward outer projected portion and the downward inner projected portion, and a concave downward inverted U-shape formed between the downward inner projected portion and outer web of the end panel, and wherein the downward interlocking protrusion at the bottom end of the downward outer projected portion of the end panel and the upward U-shape in-between the outermost inner web and upward projected portion of the main panel are coupled and interlocked with each other, and at the same time, the upward interlocking protrusion at the upper end portion of the outer web of the main panel and the concave downward inverted U-shape formed between the downward inner projected portion and the outer web of the end panel are coupled and interlocked with each other, collectively forming two simultaneously interlocking concavo-convex snap-fit connections at a time, subsequently, forming an assembled paneled structure in which the open-sectional portion of the main panel are transformed to closed-sectional shape after its connection with the end panel.

* * * * *